US008388079B2

(12) United States Patent
Nakano et al.

(10) Patent No.: US 8,388,079 B2
(45) Date of Patent: Mar. 5, 2013

(54) INKJET HEAD, METHOD OF DETECTING EJECTION ABNORMALITY OF THE INKJET HEAD, AND METHOD OF FORMING FILM

(75) Inventors: Teruyuki Nakano, Hiroshima (JP); Yasuhiro Kozawa, Hiroshima (JP)

(73) Assignee: Kabushiki Kaisha Ishii Hyoki, Hiroshima (JP)

( * ) Notice: Subject to any disclaimer, the term of this patent is extended or adjusted under 35 U.S.C. 154(b) by 1093 days.

(21) Appl. No.: 11/920,351

(22) PCT Filed: Aug. 24, 2005

(86) PCT No.: PCT/JP2005/015359

§ 371 (c)(1),
(2), (4) Date: Jan. 8, 2009

(87) PCT Pub. No.: WO2007/023539

PCT Pub. Date: Mar. 1, 2007

(65) Prior Publication Data

US 2009/0231368 A1 Sep. 17, 2009

(51) Int. Cl.
*B41J 3/36* (2006.01)

(52) U.S. Cl. ..... 347/2; 347/3; 347/5

(58) Field of Classification Search ..... 347/2, 3, 347/4, 5, 14, 19

See application file for complete search history.

(56) References Cited

U.S. PATENT DOCUMENTS

| | | | | |
|---|---|---|---|---|
| 5,257,043 | A | 10/1993 | Kneezel | |
| 5,975,687 | A | 11/1999 | Powers | |
| 2003/0222927 | A1 * | 12/2003 | Koyama | 347/2 |
| 2005/0007530 | A1 | 1/2005 | Hiruma | |

FOREIGN PATENT DOCUMENTS

| | | |
|---|---|---|
| CN | 1572493 | 2/2005 |
| JP | 03-249623 | 11/1991 |
| JP | 05-149769 | 6/1993 |
| JP | 05-270099 | 10/1993 |
| JP | 07-092468 | 4/1995 |
| JP | 09-136436 | 5/1997 |
| JP | 09-138410 | 5/1997 |
| JP | 11-227172 | 8/1999 |
| JP | 3073493 | 2/2001 |
| JP | 2001-322295 | 11/2001 |

(Continued)

OTHER PUBLICATIONS

Chinese Office Action issued Jul. 3, 2009 for corresponding Chinese Application No. 200580051399.5.

International Search Report mailed Dec. 6, 2005 for International Application No. PCT/JP2005/015359.

*Primary Examiner* — Lam S Nguyen

(74) *Attorney, Agent, or Firm* — Wenderoth, Lind & Ponack, L.L.P.

(57) ABSTRACT

There are provided n number of line-type inkjet nozzles (2) which include nozzles (4) that eject a liquid material and are arranged in a row, and which are arranged in parallel with each other so that positions of the nozzles (4) are shifted from each other by 1/n of a nozzle pitch (P1). Thus, an inkjet head (1) as a whole has a state equivalent to a state in which the nozzles (4) are arranged at 1/n of a nozzle pitch of one line-type inkjet nozzle (2). The inkjet head (1) is capable of adjusting a timing of ejecting the liquid material for each line-type inkjet nozzle (2). Accordingly, adjustment of a dot pitch such as fine coating and rough coating can be performed with ease.

8 Claims, 16 Drawing Sheets

FOREIGN PATENT DOCUMENTS

| | | |
|---|---|---|
| JP | 2003-083714 | 3/2003 |
| JP | 2004-074655 | 3/2004 |
| JP | 2004-216210 | 8/2004 |
| JP | 2004-337771 | 12/2004 |
| JP | 2004-345281 | 12/2004 |
| JP | 2005-031144 | 2/2005 |
| JP | 2005-193618 | 7/2005 |
| JP | 2005-205636 | 8/2005 |

* cited by examiner

INKJET HEAD, METHOD OF DETECTING EJECTION ABNORMALITY OF THE INKJET HEAD, AND METHOD OF FORMING FILM

TECHNICAL FIELD

The present invention relates to an inkjet head, a method and a device for detecting an ejection abnormality of the inkjet head, and a method (film coating method) and a device for forming a film by using the inkjet head.

BACKGROUND ART

In recent years, a so-called inkjet method using an inkjet head has been widely employed in a case of performing printing using ink on a print medium such as paper, in a case of forming an orientation film or applying UV ink onto a substrate (transparent substrate) of a liquid crystal display device or the like, or in a case of applying a color filter onto a substrate of an organic EL display device.

For example, JP 3073493 B discloses an inkjet head including line-type inkjet nozzles in which nozzles are arranged in a row. JP 3073493 B also discloses a technology of improving a process speed for coating a liquid material by devising arrangement of the line-type inkjet nozzles as shown in FIGS. 5 to 7 of JP 3073493 B (Patent Document 1).

Further, JP 09-138410 A discloses an inkjet head for forming a film with a uniform thickness, in which nozzles are arranged in a plurality of rows and in a plurality of columns in a predetermined area, and inkjet nozzles in an arbitrary row are arranged by being shifted by a half pitch with respect to the arrangement of nozzles in an adjacent row. JP 09-138410 A also discloses a technology of coating a liquid material while moving, in a zig-zag manner, the line-type inkjet nozzles including nozzles that eject the liquid material and are arranged in series, to thereby form a film with a uniform thickness (Patent Document 2).

Further, as an example of a device for detecting an ejection abnormality of an inkjet head, JP 05-149769 A discloses a technology of picking up an image of a flying liquid droplet which is ejected from the inkjet head, from a direction orthogonal to a direction in which the liquid droplet flies, and integrating the flying image with respect to a central axis of the liquid droplet, assuming that the liquid droplet has a rotationally symmetrical shape with respect to a central axis of the flying direction, thereby calculating a volume of the liquid droplet (Patent Document 3).

Further, JP11-227172A discloses a technology of picking up an image of a liquid droplet ejected from the inkjet head a plurality of times by providing time differences, and measuring a droplet velocity of the liquid droplet based on positional differences and the time differences between a plurality of taken images of the liquid droplet (Patent Document 4).

Further, JP2001-322295A discloses a method of applying light at the time of photographing, and also discloses a technology in which a light source and image taking means are arranged so as to face a scattering plate, and a liquid droplet which is an object to be measured is positioned among the light source, the image taking means, and the scattering plate, and light irradiated from the light source is scattered by the scattering plate, thereby picking up an image of the liquid droplet by the image taking means (Patent Document 5).

On the other hand, manufacturing processes for a liquid crystal display device include a process of forming an orientation film on a transparent substrate. The orientation film is used for controlling a liquid crystal orientation, and an orientation film material such as polyimide is coated and formed on the substrate to thereby form the orientation film.

As an orientation film coating forming method, a flexographic printing method using a flexographic printing apparatus is generally employed. However, in recent years, a method of forming an orientation film on a transparent substrate by using a print head, that is, the so-called inkjet method is proposed (see Patent Documents 6 and 7).

In the case of the flexographic printing method, pattern formation of the orientation film can be easily performed and higher productivity is obtained, whereas the method has the following problems. That is: for example, (1) a failure that the orientation film material is not coated on the transparent substrate repeatedly occurs in a case where dust is attached to a surface of a relief printing plate; (2) usage of the orientation film material is large in amount; (3) a recovery time becomes longer and operating rates of the apparatus are lowered because cleaning for an anilox roll, a relief printing plate, or the like is necessary in a case where the apparatus is stopped due to a trouble or the like; and (4) coating with respect to a substrate with large irregularities or a substrate having a curved surface cannot be performed.

The inkjet method enables solving those problems inherent in the flexographic printing method, and obtainment of a stable film quality. An inkjet printer used for the inkjet printing method includes a movable print head unit. In general, the print head unit has about 1 to 6 (4 in FIG. 22) print heads mounted thereto as illustrated in FIG. 22. The print head unit reciprocates in a width direction of the transparent substrate in a direction of 90° (vertically in FIG. 22) with respect to an advancing direction (rightwardly in FIG. 22) of the transparent substrate which is a material to be coated. In synchronization with the reciprocation, the transparent substrate is intermittently moved in an advancing direction (longitudinal direction), thereby forming the orientation film on the transparent substrate.

[Patent Document 1] JP 3073493 B (FIGS. 5 to 7)
[Patent Document 2] JP 09-138410 A (FIGS. 1, 4, and 5)
[Patent Document 3] JP 05-149769 A
[Patent Document 4] JP 11-227172 A
[Patent Document 5] JP 2001-322295 A
[Patent Document 6] JP 03-249623 A
[Patent Document 7] JP 07-092468 A

DISCLOSURE OF THE INVENTION

Problem to be Solved by the Invention

Incidentally, in order to coat a liquid material with high definition, it is necessary to narrow a nozzle pitch in an inkjet head. However, there is a physical limit to narrow the nozzle pitch. Accordingly, there is a limit to narrow the nozzle pitch with an area-type inkjet nozzle disclosed in the above-mentioned Patent Document 2. In a method of coating the liquid material while a line-type inkjet nozzle is moved in a zig-zag manner, movement of the inkjet nozzle is complicated, which lowers process speed. Further, when the inkjet nozzle is moved in a complicated manner, a flying curve of a liquid droplet is liable to occur, which makes it difficult to control impact positions of liquid droplets with high precision.

Therefore, it is a first technical object of the present invention to narrow the nozzle pitch as much as possible to appropriately adjust the impact positions of liquid droplets.

On the other hand, as described above, there is known the method of calculating the position and the speed of liquid droplets based on taken images of the liquid droplet to detect an ejection abnormality. However, conventionally, it is difficult to detect the ejection abnormality of the inkjet head by using the taken images of the liquid droplet.

Up to now, when a state where the liquid material is ejected from the nozzle of the inkjet head is photographed, a camera and a light source (stroboscopic light source) are disposed so as to be opposed to each other through an intermediation of the liquid material, and reflected light, which is obtained by reflecting light from the light source by the liquid droplet, is caused to enter a finder of the camera. However, in this case, the light entering the finder of the camera is extremely intense, and halation occurs in some cases.

Therefore, it is a second technical object of the present invention to perform detection of the ejection abnormality of the inkjet head with ease and reliability.

Further, in a case where a film having a uniform thickness is to be formed with high precision by using the inkjet head, there arises the following problems. That is, in the case of forming the film by using the inkjet head, even when the liquid material is uniformly coated on the material to be coated, the thickness of the liquid material temporarily becomes substantially uniform due to fusion of liquid droplets caused after ejection of the liquid material, but, thereafter, the film thickness is changed in a drying process carried out after the fusion of liquid droplets, which generates a difference in film thickness. This may be caused because the coated liquid material is dried from the surface thereof. In particular, when the liquid material is uniformly coated on the material to be coated, the thickness of the liquid droplet is liable to be uniform at a central portion of the film, but at a circumferential portion (edge portion and corner portion) of the film, a difference in film thickness is liable to occur in the drying process after the fusion of liquid droplets. For this reason, even when the liquid material is uniformly coated merely by taking ejection characteristics of the inkjet head into consideration, it is difficult to form the film having the uniform thickness with high precision. In addition, in a case of using a plurality of inkjet heads, due to effects of the ejection characteristics of each of the inkjet heads, it is difficult to make the thickness of the inkjet head uniform.

Therefore, it is a third technical object of the present invention to form a film with a thickness as uniform as possible by using an inkjet head.

In addition, it is important for the inkjet method to stably eject an orientation film material from the print head and how to form a uniform orientation film from the orientation film material deposited on the transparent substrate as numerous dots. Specifically, if the material to be coated is a material which easily absorbs a liquid (ink), such as paper or cloth, unevenness of a coating liquid is not caused on the surface of the material to be coated. However, if the material to be coated is a material which does not absorb or hardly absorbs a liquid (ink), such as glass or a film, a dot film of a coating liquid is formed on a coating surface. Accordingly, there is a fear in that the film unevenness (unevenness of film thickness) occurs in a case where a part or the whole of the dot film is overlapped. For this reason, not only movement control of the print head with accuracy, but also adjustment of viscosity of the coating liquid and a deaerating process within the print head are necessary.

The unevenness in film thickness typically occurs in a seam between films. A seam B between coated films is shown in FIG. 24 as an enlarged image. In the inkjet method, in order to eliminate the unevenness in film thickness caused in the seam or the like, and to realize the uniformity in coating film thickness, there is performed a technology for recoating and partial recoating. Specifically, as illustrated in FIG. 25(A), the recoating is performed by shifting the pitch in an X-direction and a Y-direction, or the partial recoating is performed in the manner as illustrated in FIG. 25(B). However, the prevention of the unevenness in film thickness caused in the seam between films has not reached a satisfactory level, and at present, a problem in terms of film quality is pointed out.

In order to solve the above-mentioned problem of the seam between films inherent in the inkjet method, it is possible to employ a structure in which a plurality of print heads are arranged in a print head unit so as to coat a wide coating surface at a time, and the material to be coated is moved in a direction orthogonal to a direction in which the print heads are arranged. Specifically, as illustrated in FIG. 23, a plurality of print heads are arranged over the entire coating width, and a material to be coated G is moved in a state where the print heads are fixed. Alternatively, as illustrated in FIG. 18, all the print heads are simultaneously moved in a coating direction in a state where a material to be coated 70 is fixed. With this structure, the coating can be completed by only one time movement of the print heads or the material to be coated G, thereby making it possible to form a high quality coating film with no seam between films and no unevenness in film thickness.

However, in the former case (FIG. 23), it is necessary that dimensions of the film coating device are twice or more of the length of the material to be coated G. In other words, assuming that the length of the material to be coated G is represented as L and the width of the print head is represented as P, the length of the device is represented as $2\ L+P+2\alpha$, with the result that the device becomes extremely large ($\alpha$ represents a peripheral width of the device). For this reason, in a so-called seventh-generation large orientation film coating device, the size of the transparent substrate (glass substrate) is, for example, 1870×2200 mm. Accordingly, the dimensions of the device are twice or more of the dimensions thereof, and a movement distance of the material to be coated G also becomes larger, which makes it extremely difficult to obtain mechanical precision. In particular, due to a fact that an installation place for the orientation film coating device is a cleanroom, an orientation film coating device of an installation space saving type is required at present. In proportion to the size of the device, the weight thereof also becomes large, which makes it difficult to transport the device at the time of installation.

On the other hand, as illustrated in FIG. 18, in a case where the material to be coated 70 is fixed, and print heads 73, which are provided over the entire coating width, are moved for coating, the length of the device is basically represented as L+2 P, which is much smaller than the device illustrated in FIG. 23.

However, the print heads are each connected with a coating liquid pipe for supplying the coating liquid to each of the print heads, a signal line for supplying coating data to a piezoelectric element of each of the print heads, a negative pressure pump, and the like. The total number of the pipes and wirings is increased in proportion to the number of the print heads. In the case of the device as illustrated in FIG. 18, the total number of the coating liquid pipes and wirings to be connected to the plurality of print heads is considerably increased, which significantly resists the movement of the print heat unit. As in the coating device for forming the orientation film for the liquid crystal display device, which requires movement control of the print head with accuracy, the device cannot be realized in effect.

The above-mentioned movable print head is suitably used for space saving, but the following problems arise in realizing the movable print head. That is: (1) it is necessary to save piping provided between the film coating device and the movement side of the print head; (2) it is necessary to save wiring provided between the film coating device and the movement side of the print head; (3) it is necessary to simplify a liquid supply pipe of the print head; (4) it is necessary to prevent the liquid surface of the ink tank from waving; (5) it is necessary to provide deaerating means between the ink tank and the print head; and (6) it is necessary to control a meniscus pressure with high precision.

Hereinafter, those problems will be sequentially described.

In the film coating device, the fixation side and the print head of the movement side are connected to each other with, for example, electrical lines and power lines, which are connected to the respective print heads, a power supply line connected to each device, and a nitrogen ($N_2$) purge pipe. The plurality of pipes and wirings allow the print heads to move, so it is necessary to contain the pipes and wirings in a common cable bear. However, the total number of pipes and wirings is extremely large, so it is essential to save the piping as described in the item (1) and save the wiring as described in the item (2).

In addition, if the piping for the print heads on the movement side is complicated, it is necessary to provide a large number of liquid supply control devices on the print head side, and thus the weight thereof is increased by that amount, and the control of the devices is complicated. For this reason, as described in the item (3), it is necessary to simplify the liquid supply pipe of the print head.

When the ink tank for supplying the coating liquid to each of the print heads is mounted to the print heads provided on the movement side, the liquid surface in the ink tank waves due to the movement of the print heads, thereby generating foam or fluctuating the meniscus pressure on the print heads to a large extent. Accordingly, it is necessary to prevent the liquid surface of the ink tank from waving as described in the item (4), to provide the deaerating means between the ink tank and the print head as described in the item (5), and to control the meniscus pressure of the print head with high precision as described in the item (6).

Therefore, it is a fourth technical object of the present invention to form an excellent coating film while a pipeline provided in the vicinity of the print heads is simplified.

Means for Solving the Problems

In order to attain the above-mentioned first technical object, according to the present invention, there is provided an inkjet head, including line-type inkjet nozzles arranged in a row, for ejecting a liquid material, in which n number of the line-type inkjet nozzles are arranged in parallel with each other so that positions of the line-type inkjet nozzles are displaced from each other by 1/n of a nozzle pitch.

A position adjustment method for the line-type inkjet nozzles of the inkjet head, which are arranged in parallel with each other, may include, for example, adjusting a position of each of the line-type inkjet nozzles to a position at which each of the line-type inkjet nozzles is to be mounted, based on an image of each of the line-type inkjet nozzles arranged in parallel each other, which is picked up by a camera.

Further, in order to attain the first technical object, according to the present invention, there is provided an inkjet head including inkjet nozzle units each including line-type inkjet nozzles arranged in series, for ejecting a liquid material, in which n number of the line-type inkjet nozzles are arranged in parallel with each other so that positions of the line-type inkjet nozzles are displaced from each other by 1/n of a nozzle pitch, in which the inkjet nozzle units are arranged in series in a direction in which the nozzles of the line-type inkjet nozzles are arranged so that positions of the inkjet nozzle units are alternately shifted from each other in a staggered manner.

A position adjustment method for the inkjet nozzle units of the inkjet head may include, for example, aligning the inkjet nozzle units to be mounted on a reference plane of a mounting shaft which has the linearly formed reference plane which becomes a reference for a mounting position of each of the inkjet nozzle units.

On the other hand, in order to attain the above-mentioned second technical object, according to the present invention, there is provided an ejection abnormality detection method for an inkjet head including calculating a position or a liquid width of a liquid material at least two positions in an ejecting direction of a nozzle based on taken images of the liquid material ejected from the nozzle of the inkjet head, to detect ejection abnormality of the nozzle.

In this case, in the case of photographing the liquid material ejected from the nozzle, a light source may be disposed so as to be opposed to the camera on an opposite side of the camera with respect to the liquid material ejected from the nozzle such that projected direct light does not enter a finder of the camera, and the camera may capture reflected light, which is projected from the light source and reflected by the liquid material ejected from the nozzle, to thereby take the image of the liquid material.

Note that the abnormality detection process for the ejection abnormality detecting device, and the control of the camera and the light source, and the like can be achieved by using a program for causing a computer to achieve various functions of the ejection abnormality detecting device, a computer readable recording medium storing the program, a computer incorporating the program and the storage medium, and the like.

Further, in order to attain the above-mentioned third technical object, according to the present invention, there is provided a film forming method, for ejecting a liquid material using an inkjet head to form a film having a uniform thickness on a material to be coated, including: a film thickness setting step of setting a thickness of the film to be formed on the material to be coated; a test ejection step of adjusting an ejected liquid droplet amount and a dot pitch by taking ejection characteristics of the inkjet head into consideration, and performing a test ejection of the liquid material with respect to a film forming area with a gray pattern at an arbitrarily selected gray level; a gray level distribution chart creating step of creating a distribution chart in which gray levels of gray patterns of the liquid material to be ejected are set for each unit area, with respect to the film forming area in which the film is formed on the material to be coated, based on the thickness of the film formed in the test ejection step such that the film having the uniform thickness can be formed with the film thickness set in the film thickness setting step; and a film forming step of ejecting the liquid material onto the material to be coated with a gray pattern at a gray level based on the gray level distribution chart created in the gray level distribution chart creating step, while the ejected liquid droplet amount and the dot pitch which are adjusted in the test ejection step are maintained, to form the film on the material to be coated.

Further, in order to attain the above-mentioned fourth technical object, according to the present invention, there is provided a film coating device, which forms a film of a coating liquid on a surface of a material to be coated G by using an inkjet printer, characterized by including: a print head unit capable of moving in a first direction on the surface of the material to be coated; and a plurality of print heads continuously mounted to the print head unit over an entire coating width in a direction orthogonal to the first direction.

With the structure, the length of the device can be set within a range of (length of material to be coated)+2×(width of print head), and the coating is completed through one time movement of the print heads. As a result, no seam is caused between coating films, and unevenness in film thickness does not occur. For the purpose of simplifying the pipeline provided around the print heads and reducing the number of pipes provided between the print head and the fixation side, in the present invention, an ink tank is disposed on the print head side, and a common liquid feed pipe is routed extremely close to each of the print heads from the ink tank. The ink tank and each of the print heads are connected to each other with a separate liquid feed pipe, with a distance therebetween being short. In addition, the ink tank and the supply tank provided on the fixation side are connected to each other with one flexible supply pipe. As a result, even when the number of the print heads to be mounted to the print head unit is increased, only one supply pipe is required, which makes it possible to reduce movement resistance of the print head unit to a large extent.

There is a fear that foam is generated in the ink tank along with the movement of the print head unit. However, in order to prevent the foam from reaching the print head, according to the present invention, the foam entering the common liquid feed pipe is recovered in a recovery tank provided on the fixation side through a recovery pipe. When the recovery pipe is separately connected to each of the print heads, the number of pipes is increased, which leads to large movement resistance of the print head unit. Accordingly, it is essential to perform deaeration (foam removal) using a pipeline in which the common liquid feed pipe and the recovery pipe are combined with each other.

The print heads are each connected with wirings for ejecting coating liquid dots from the nozzle. The kinds of wirings include a power supply line, a high pressure pulse line, and a coating data signal line. When the plurality of wirings are routed to the fixation side for each print head, the number of wirings is considerably increased, which leads to large movement resistance of the print head unit. As a result, it becomes impossible to perform the movement control of the print head unit with accuracy. In the present invention, as a coating control portion, for example, a relay board of a serial-in-parallel-out shift register type is mounted to the print head unit, and a power source and signals are supplied from the control portion provided on the fixation side to the print head unit with one transmission line. Coating data is transmitted from the relay board to each of the print heads. A serial transmission speed of the transmission line is overwhelmingly higher than a coating speed of the print head, which enables achievement of the structure.

In the present invention, for the purpose of simplifying the piping structure around the print head and reliably performing deaeration of a gas mixed into the coating liquid, each of the separate liquid feed pipes for feeding the coating liquid, which leads to each of the plurality of print heads, is connected to the common liquid feed pipe leading to one ink tank storing one kind of coating liquid. In addition, separate gas flow pipes, each of which leads to each of connection portions between the common liquid feed pipe and the plurality of separate liquid feed pipes, each of the print heads, or each portion therebetween, and is capable of flowing a gas, are each connected to a common gas flow pipe capable of being opened and closed with respect to the atmosphere. Here, specifically, the above-mentioned "print head" means a liquid reservoir portion leading to an ejection nozzle (for example, a plurality of ejection nozzles) provided inside a print head.

With this structure, the coating liquid stored in the one ink tank is fed to each of the print heads through each of the separate liquid feed pipes from the common liquid feed pipe. In the process of feeding the coating liquid, if a gas such as air exists in the common liquid feed pipe, the gas can be released to the atmosphere from each of the separate gas flow pipes through the common gas flow pipe. Specifically, at an initial stage where the coating liquid is started to flow from the ink tank to the common liquid feed pipe, a gas exists in the common liquid feed pipe in many cases, and the gas may flow into each of the separate liquid feed pipe together with the coating liquid, and further flow into each of the print heads. However, the separate gas flow pipes are each connected to each of the connection portions between the common liquid feed pipe and each of the separate liquid feed pipes, each of the print heads, or the each portion therebetween. The separate gas flow pipes are each connected to the common gas flow pipe capable of opening and closing with respect to the atmosphere. Accordingly, when the common gas flow pipe is opened to the atmosphere during a period in which the coating liquid can flow into the print heads from the common liquid feed pipe through each of the separate liquid feed pipe, the gas can be released to the atmosphere from each of the separate gas flow pipes through the common gas flow pipe. As a result, the situation where the coating liquid is stored together with the gas in the common gas flow liquid pipe and each of the print heads can be avoided, thereby making it possible to effectively prevent inhibition of the ejection of the coating liquid from the print heads due to existence of the gas.

In addition, while the coating liquid flows from the common liquid feed pipe through each of the separate liquid feed pipes to be stored in each of the print heads, the gas is rapidly released from the common gas flow pipe through each of the separate gas flow pipes, thereby effectively preventing an adverse effect of the gas on the coating liquid stored in each of the print heads. As a result, the coating liquids stored in each of the print heads each have a uniform pressure after the coating liquids flow thereinto, and variation in ejection of the coating liquid from each of the print heads is not caused, and ejection of the coating liquid from each of the print heads is possible in a state where excellent responsiveness is secured.

Further, the separate liquid feed pipes are each connected to the common liquid feed pipe which leads to one ink tank, and the separate gas flow pipes are each connected to the common gas flow pipe which can be opened to the atmosphere. As a result, all the pipes through which the coating liquid and the gas flow can be simplified. In addition, the number of control means constituted by valve means and the like, for controlling starting and stopping of feeding of the coating liquid from the ink tank to each of the print heads, can be reduced, and the number of control means constituted by valve means for releasing and enclosing the gas with respect to the atmosphere can also be reduced, thereby making it possible to simplify the structure of the liquid feeding device and reduce manufacturing costs.

In this case, it is preferable that the gas be released to the common gas flow pipe from the connection portion between the common liquid feed pipe and the separate gas flow pipe provided on the lowermost stream side, or from the vicinity thereof.

Thus, the gas flowing through the common liquid feed pipe is reliably released to the common gas flow pipe to be released into the atmosphere. As a result, a malfunction due to the gas remaining in the common liquid feed pipe or flowing from the common liquid feed pipe into each of the print heads hardly occurs.

In the case where each of the separate gas flow pipes is connected to the connection portion between the common liquid feed pipe and each of the liquid feed pipes, the gas, which is fed from the ink tank through the common liquid feed pipe together with the coating liquid, is to be released to the atmosphere from the connection portions between each of the separate liquid feed pipes and the common liquid feed pipe through each of the separate gas flow pipes and the common gas flow pipe, immediately before the gas enters each of the separate liquid feed pipes. Note that the gas already remaining in each of the print heads is to be released into the atmosphere from ejection nozzles of the print heads.

In the case where the separate gas flow pipes are connected to the print heads, the gas flowing into the print heads and the gas remaining in the print heads are to be released into the atmosphere through each of the separate gas flow pipes connected to each of the print heads, and through the common gas flow pipe.

Further, in a case where the separate gas flow pipes are each connected between each of the connection portions and each of the print heads, that is, at a halfway position of each of the separate liquid separating pipes between the connection portions and each of the print heads, the gas fed from the ink tank and passing through the common liquid feed pipe together with the coating liquid is to be released into the atmosphere through each of the separate gas flow pipes and the common gas flow pipe even after the gas flows into each of the separate liquid feed pipes. Note that, also in this case, the gas already remaining in the print heads is to be released into the atmosphere from the ejection nozzles of the print heads.

In the above-mentioned structure, it is preferable to connect the common gas flow pipe to a negative pressure pipe which leads to a negative pressure source.

Thus, after the coating liquid is flown into each of the print heads, the common gas flow pipe is closed with respect to the atmosphere, and then the negative pressure from the negative source is caused to act on the common gas flow pipe, each of the separate gas flow pipes, and each of the print heads leading to the common gas flow pipe. As a result, the internal pressure of the coating liquid of each of the print heads is reduced, so-called liquid drop from a leading edge of the ejection nozzle is effectively prevented, and the internal pressure can be uniformly reduced among the print heads, thereby making it possible to preferably eject the coating liquid without causing variation.

In this case, it is preferable that the common gas flow pipe include a bypass pipe leading to the negative pressure pipe, and the separate gas flow pipes be connected at predetermined intervals.

Thus, the negative pressure from the negative pressure pipe acts on the separate gas flow pipes arranged at the predetermined intervals through the bypass pipe, thereby making it possible to apply the negative pressure to the coating liquid contained in the print heads with excellent responsiveness, uniformity, and stability.

In the above-mentioned structure, it is preferable to employ a structure in which a pressure gas from a gas pressure source is pressure-fed into the internal space of the ink tank.

With the structure, when the pressure air from the pressure gas source is flown into the internal space of the ink tank, the coating liquid stored in the ink tank is swept into the common liquid feed pipe by the pressure air, and is filled in each of the print heads through each of the separate liquid feed pipes. As a result, the coating liquid can be fed to each of the print heads with uniform pressure, and the coating liquid is filled in each of the print heads from the ink tank in an extremely short time period, which leads to swiftness of the filling operation and improvement of the operation efficiency.

In the above-mentioned structure, it is preferable that the common gas flow pipe extend in the horizontal direction above the liquid surface of the ink tank, each of the separate gas flow pipes extend downward from the common liquid feed pipe, the common liquid feed pipe extend in the horizontal direction at a position below the common gas flow pipe and above the print heads, and each of the separate liquid feed pipes extend downward from the common liquid feed pipe.

With this structure, even when a pipe or the like for releasing the gas into the atmosphere is not provided, the gas can be released into the atmosphere from the common liquid feed pipe and the print heads with reliability and efficiency, owing to a natural phenomenon in which the gas comes upward in the coating liquid.

Effects of the Invention

In the inkjet head according to the present invention which is accomplished to attain the first technical object, there are provided n number of line-type inkjet nozzles which include nozzles that eject a liquid material and are arranged in a row, and which are arranged in parallel with each other such that positions of the nozzles are shifted from each other by 1/n of a nozzle pitch. As a result, in the inkjet head as a whole, the nozzle pitch can be made narrower than the physical limit to reduce the nozzle pitch. In addition, since the line-type inkjet nozzles are combined with each other, by adjusting an ejection timing of each of the line-type inkjet nozzles, the dot pitch can be adjusted and adjustment such as fine coating and rough coating can be performed with ease. Further, in the position adjustment method for the line-type inkjet nozzles according to the present invention, the position of each of the line-type inkjet nozzles is adjusted to a position at which each of the line-type inkjet nozzles is to be mounted, based on an image of each of the line-type inkjet nozzles arranged in parallel with each other, which is picked up by a camera. Accordingly, the positions of the line-type inkjet nozzles can be adjusted with precision. Further, in the position adjustment method for the inkjet nozzle units according to the present invention, by using a mounting shaft having a reference plane being a reference for a mounting position of each of the inkjet nozzle units, the inkjet nozzle units are positioned to mount on the reference plane of the mounting shaft. The reference plain surface of the mounting shaft is one plane surface, and the straightness and the flatness thereof can be relatively easily secured. For this reason, the precision of the reference surface to which the inkjet nozzles units are mounted can be relatively easily secured, thereby making it possible to perform positioning of the inkjet nozzle units with precision to mount thereon. In those inkjet heads, the nozzle pitch can be made narrower, and adjustment of the dot pitch can be performed with ease, so the inkjet heads are suitable as, for example, inkjet print heads for an orientation film forming device.

In the method of detecting ejection abnormality of the inkjet head according to the present invention which is accomplished to attain the above-mentioned second technical object, based on taken images of a liquid material ejected from a nozzle of the inkjet head, at least two positions in an ejecting direction of the nozzle, a position or a liquid width of the liquid material is calculated to detect ejection abnormality of the nozzle. In a case where there occurs an ejection abnormality in the nozzle, a remarkable difference is obtained in amount of characteristic of the position or the liquid width of the liquid material. Thus, the ejection abnormality of the nozzle can be detected with ease and reliability. Further, a light source is disposed so as to be opposed to the camera on an opposite side of the camera with respect to the liquid material ejected from the nozzle so that direct light projected from the light source does not enter a finder of the camera, and reflected light obtained by reflecting the direct light, which is projected from the light source, by the liquid material ejected from the nozzles, is captured by the camera. As a result, when the liquid material ejected from the nozzles, is photographed, malfunctions such as halation can be suppressed, and the liquid material can be photographed with higher definition. Accordingly, the ejection abnormality detecting device in which the light source is disposed in the above-mentioned manner is suitably used for the above-mentioned ejection abnormality detection method.

Further, in the film forming method according to the present invention which is accomplished to attain the above-mentioned third technical object, in the test ejection step, when a film thickness set in the film thickness setting step and ejection characteristics of the inkjet head are taken into consideration, the test ejection is performed with a gray pattern at an arbitrarily selected gray level. In the test ejection step, film thickness change obtained in the drying process carried out after fusion of liquid droplets is not taken into consideration, so the thickness of the formed film is not made uniform in some cases. Further, in the film forming method according to the present invention, based on the thickness of the film formed in the test ejection step, a distribution chart is created in which gray levels of the gray patterns of the liquid material to be ejected are set for each unit area, with respect to a film forming area in which the film is formed on a material to be coated such that the film having a uniform thickness can be formed with the thickness set in the film thickness setting step (gray level distribution chart creating step). Influences of the film thickness change obtained in the drying process after fusion of liquid droplets are reflected in the gray level distribution chart created in the gray level distribution chart creating step. Accordingly, the liquid material is ejected onto the material to be coated with the gray pattern at the predetermined gray level based on the gray level distribution chart created in the gray level distribution chart creating step (film forming step), thereby making it possible to form the film having the uniform thickness on the material to be coated.

In addition, the coating device for forming a film of a coating liquid on a surface of a material to be coated by using an inkjet printer, according to the present invention which is accomplished to attain the above-mentioned fourth technical object, includes: a print head unit capable of moving in a first direction on the surface of the material to be coated; and a plurality of print heads continuously mounted to the print head unit in a direction orthogonal to the first direction. Accordingly, the length of the device can be set to be substantially in a range of (length of material to be coated G)+2× (width of print head). Further, the coating is completed through one time movement of the print head unit, with the result that there occurs no seam generated between coating films and no unevenness in film thickness. In addition, even when a plurality of print heads are arranged in parallel with each other over the entire width of the material to be coated, the pipeline provided in the vicinity of the print heads can be simplified and the number of pipes and wirings provided between the print head and the fixation side can be reduced to a large extent. As a result, the movement resistance of the print head can be reduced to a large extent by containing the pipes and wirings in the common cable bear, and the movement control with accuracy can be performed.

FIG. [11] A side diagram illustrating a state where a liquid droplet is photographed using the ejection abnormality detecting device.

Figure 12:
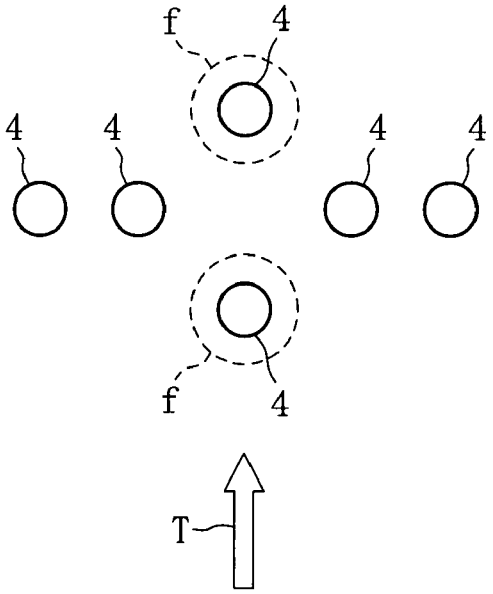

[FIG. 12] A plan diagram illustrating a flying curve of a liquid material in a photographing direction of the camera.

Figure 13:
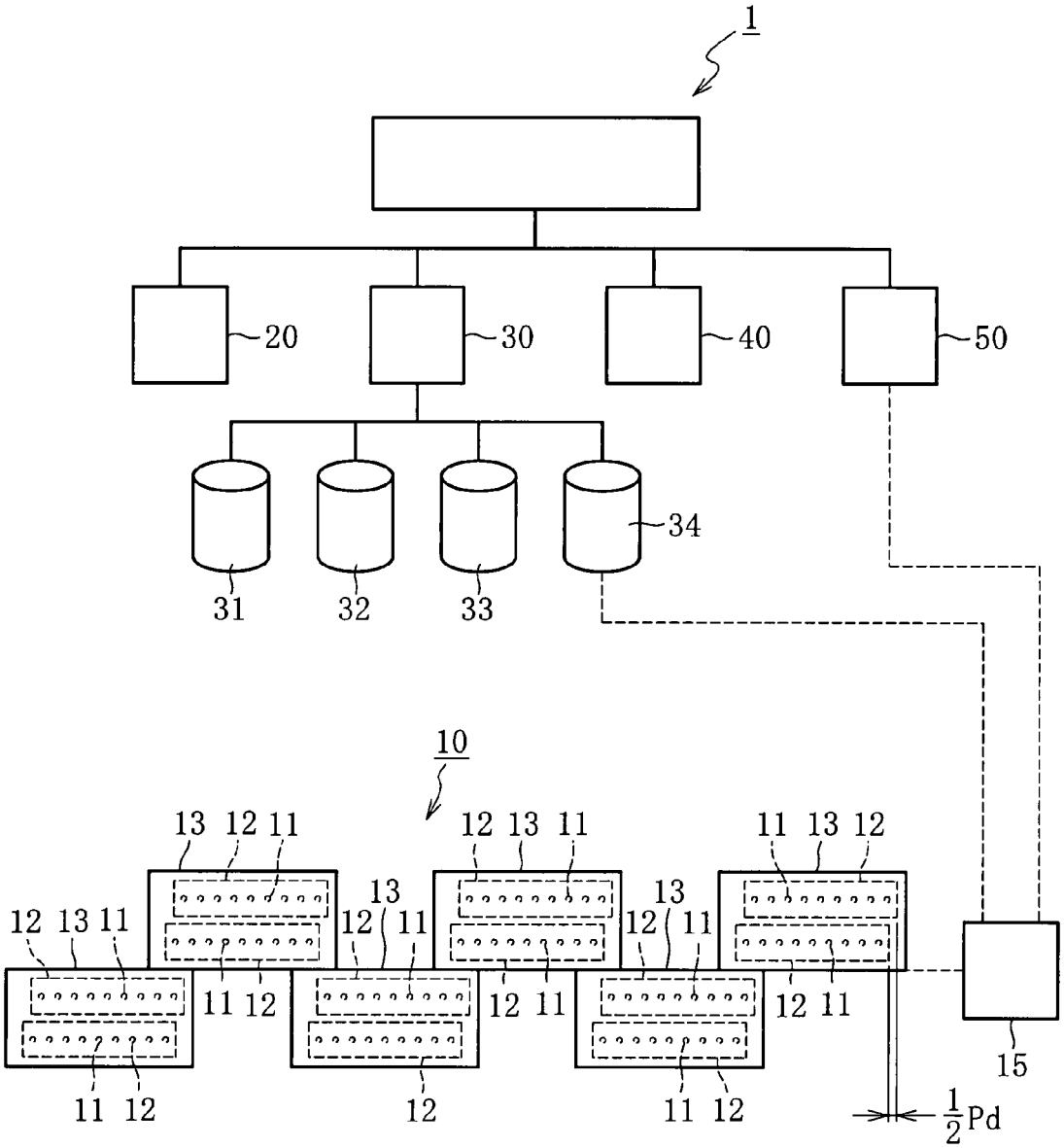

[FIG. 13] A diagram illustrating a structure of a film forming device according to a third embodiment of the present invention.

Figure 14:
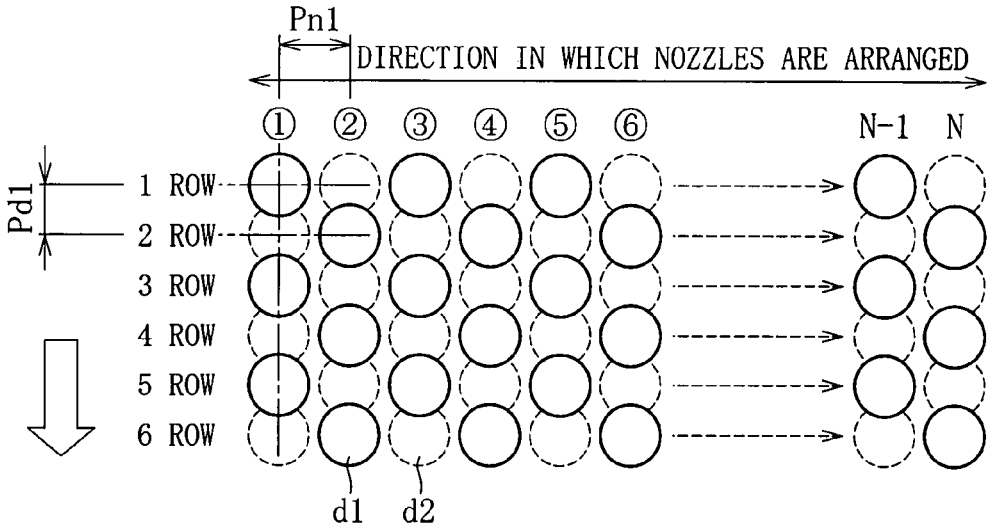

[FIG. 14] A plan diagram illustrating dot positions of an inkjet head according to the third embodiment of the present invention.

Figure 15:
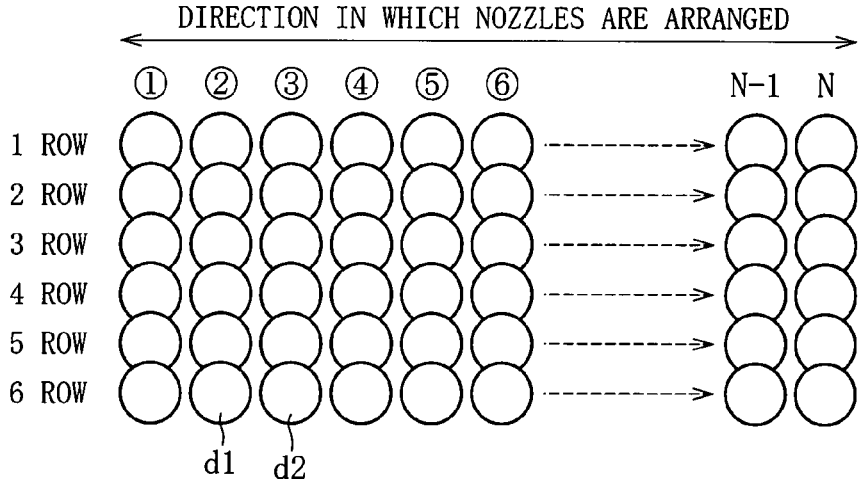

[FIG. 15] A plan diagram illustrating dot positions of a gray pattern at a gray level of 100%.

Figure 16:
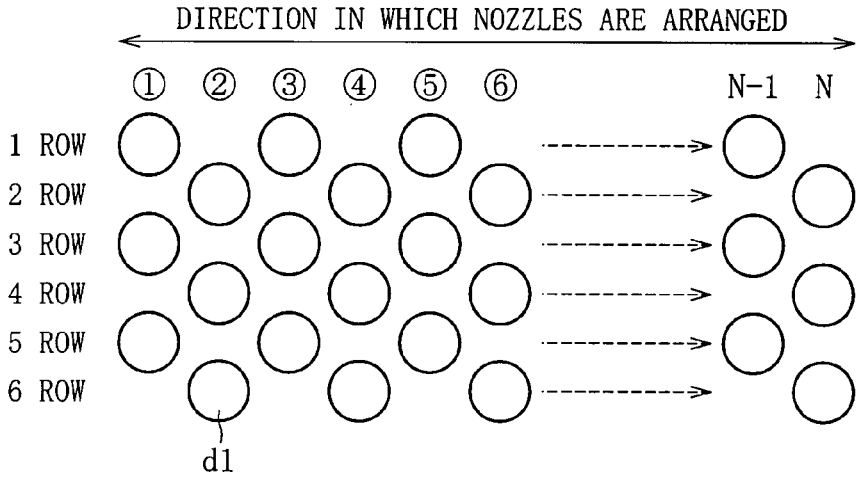

[FIG. 16] A plan diagram illustrating dot positions of a gray pattern at a gray level of 50%.

Figure 17:
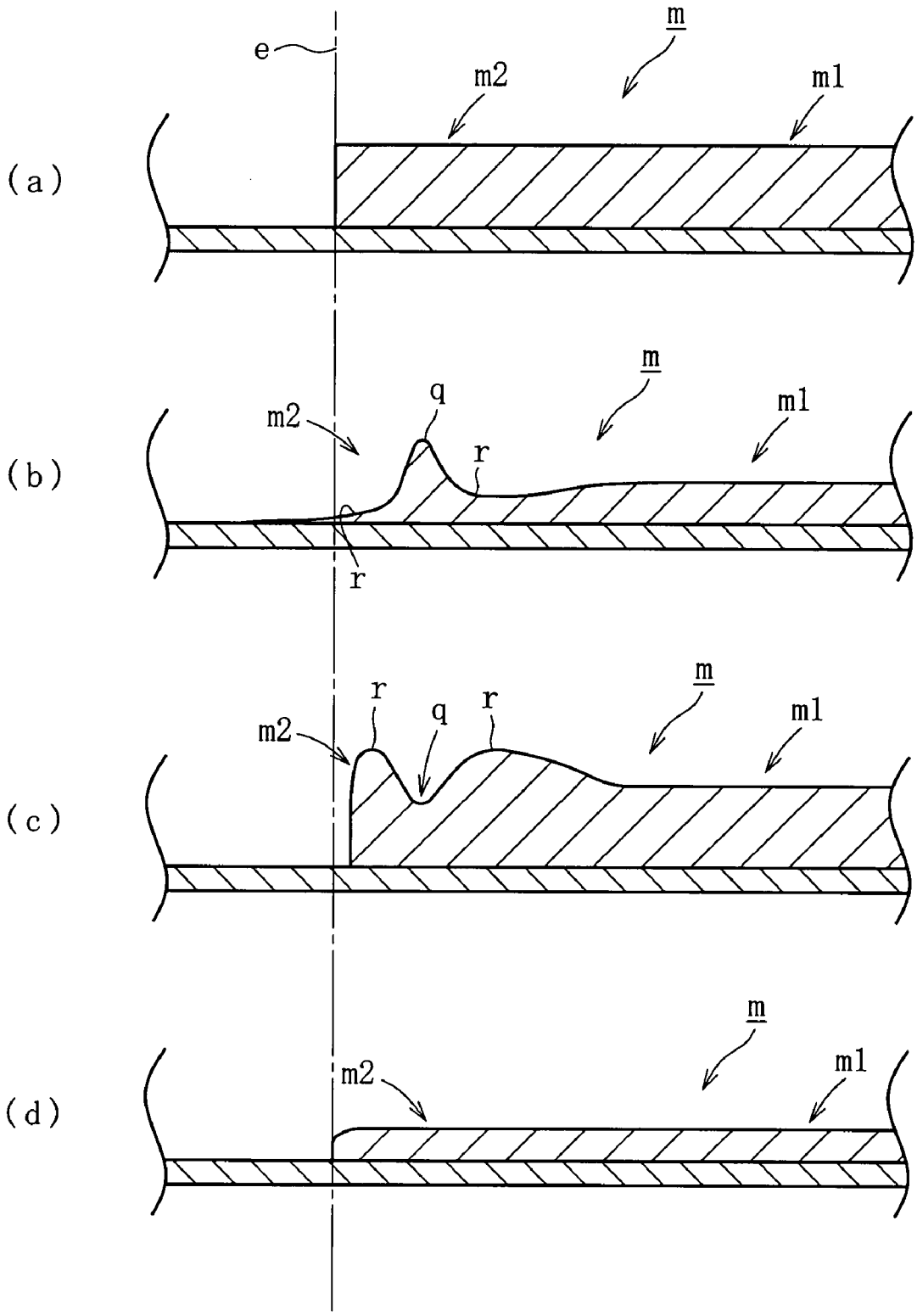

[FIG. 17] A portion (a) is a cross-sectional diagram illustrating an ejecting state of a liquid material in a test ejection process, and a portion (b) is a diagram illustrating a thickness of a film formed in the test ejection process. A portion (c) is a cross-sectional diagram illustrating an ejecting state of the liquid material in a film forming process, and a portion (d) is a diagram illustrating a thickness of a film formed in the film forming process.

Figure 18:
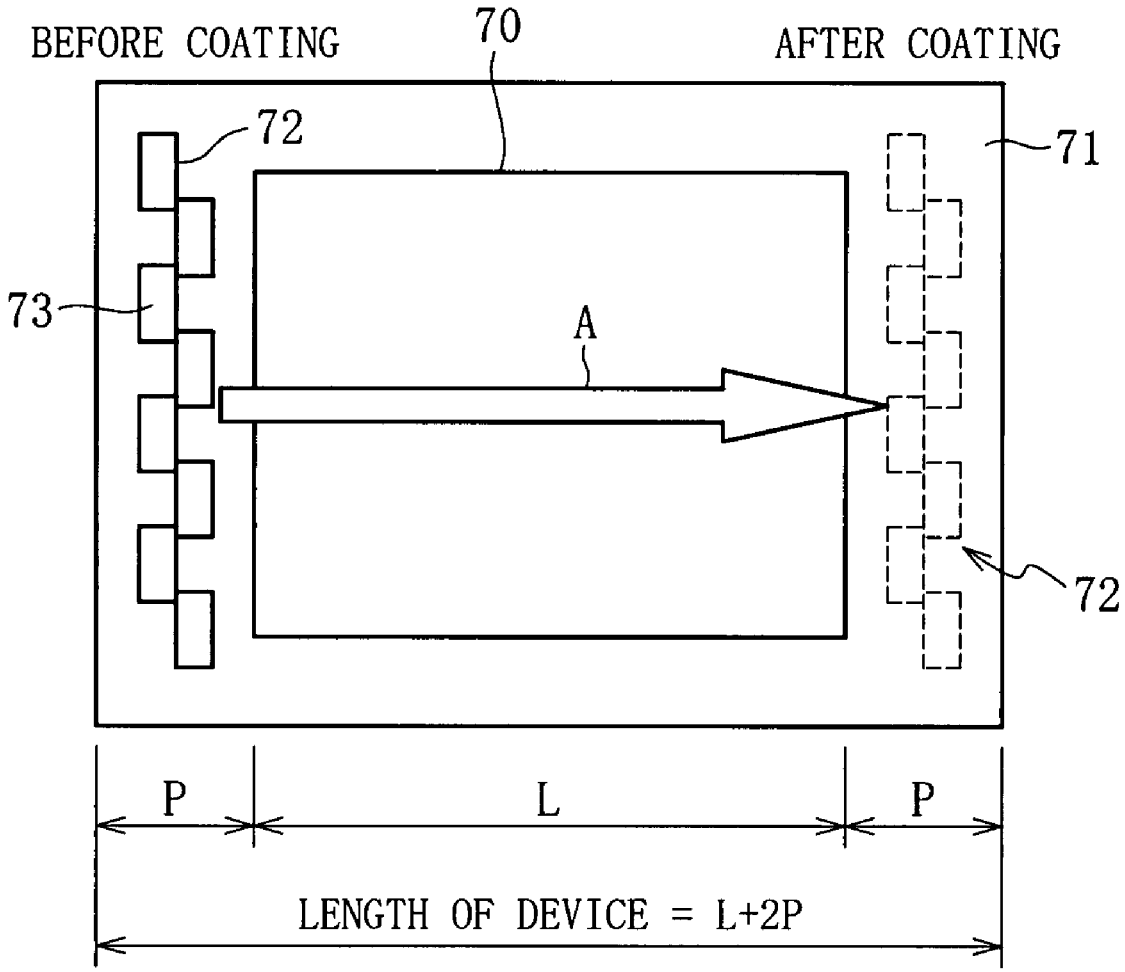

[FIG. 18] A plan diagram of a film coating device according to a fourth embodiment of the present invention.

Figure 19:
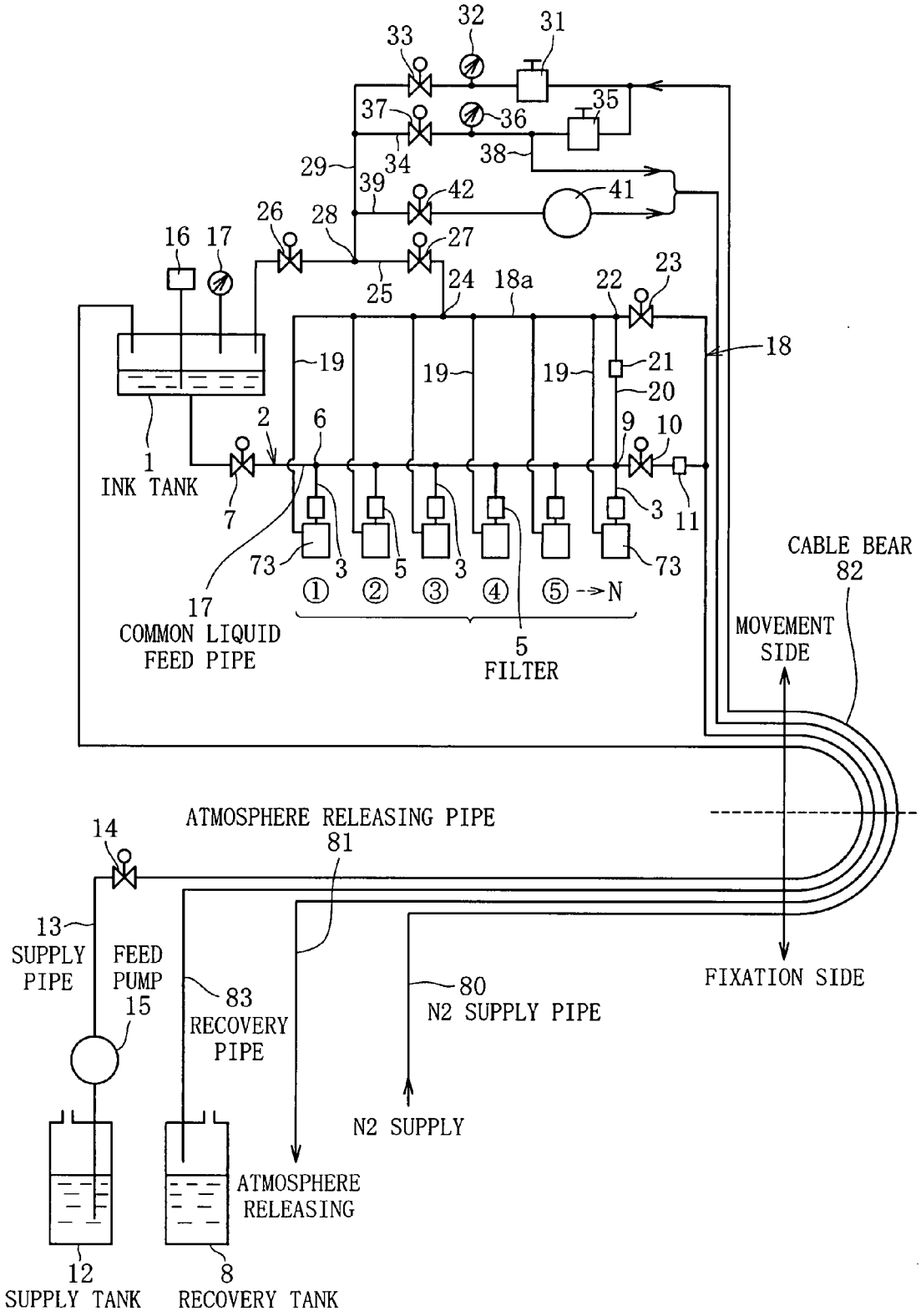

[FIG. 19] A line diagram of the film coating device.

Figure 20:
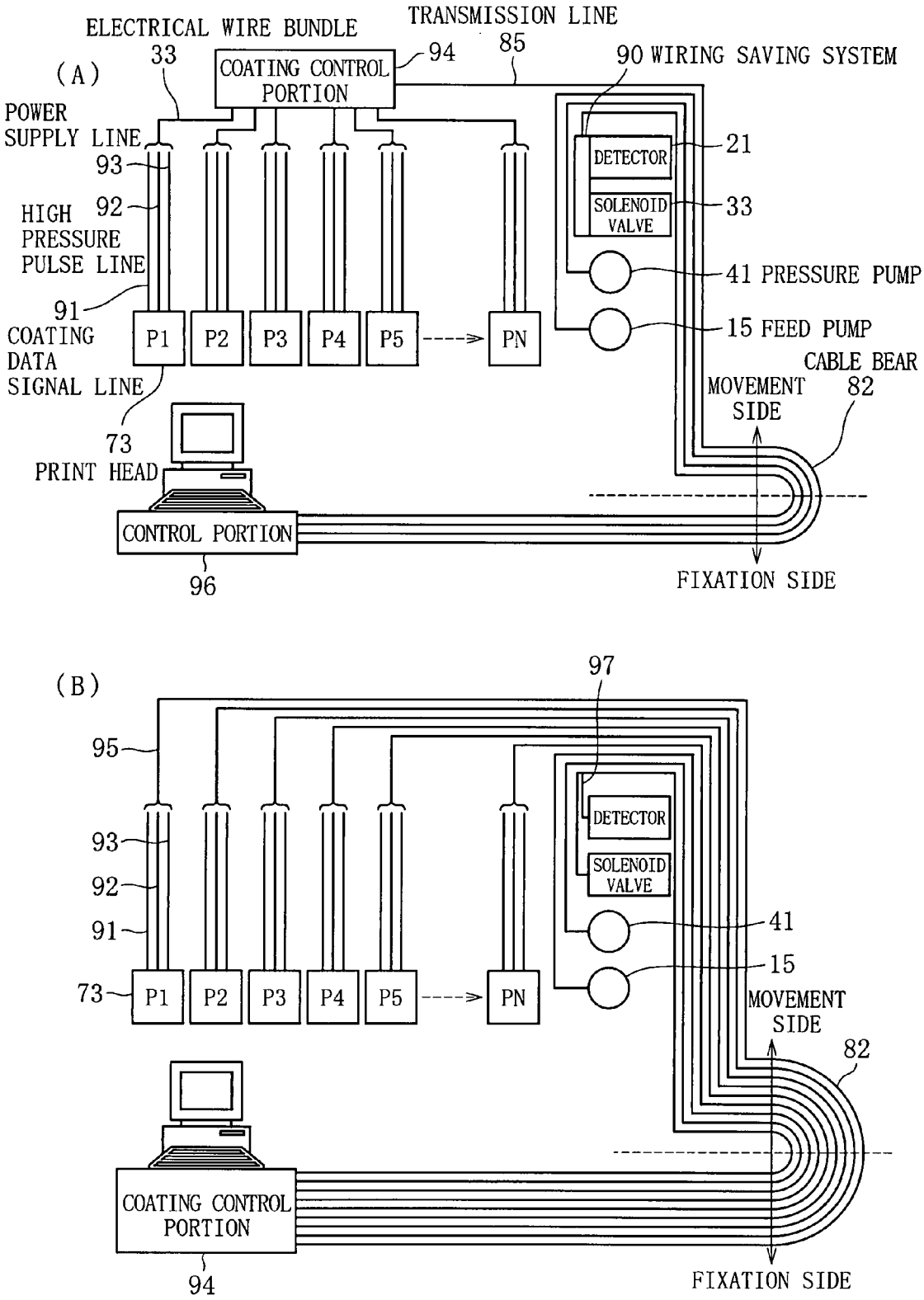

[FIG. 20] A portion (A) is a wiring diagram of the film coating device, and a portion (B) is a typical wiring diagram of the film coating device.

Figure 21:
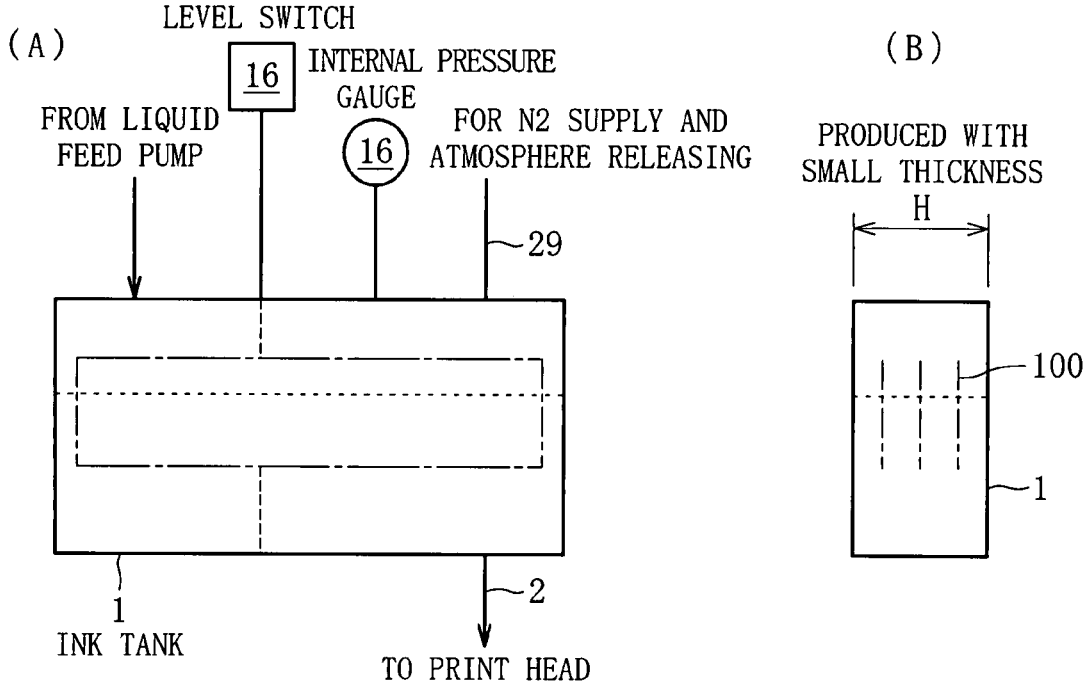

[FIG. 21] A portion (A) is a front diagram of an ink tank, and a portion (B) is a side diagram of the ink tank.

Figure 22:
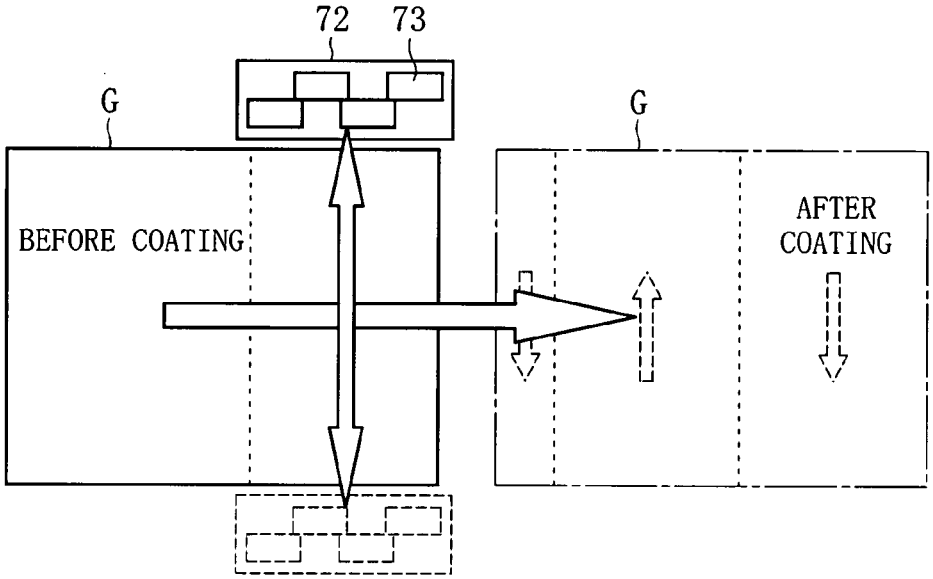

[FIG. 22] A plan diagram of a conventional film coating device.

Figure 23:
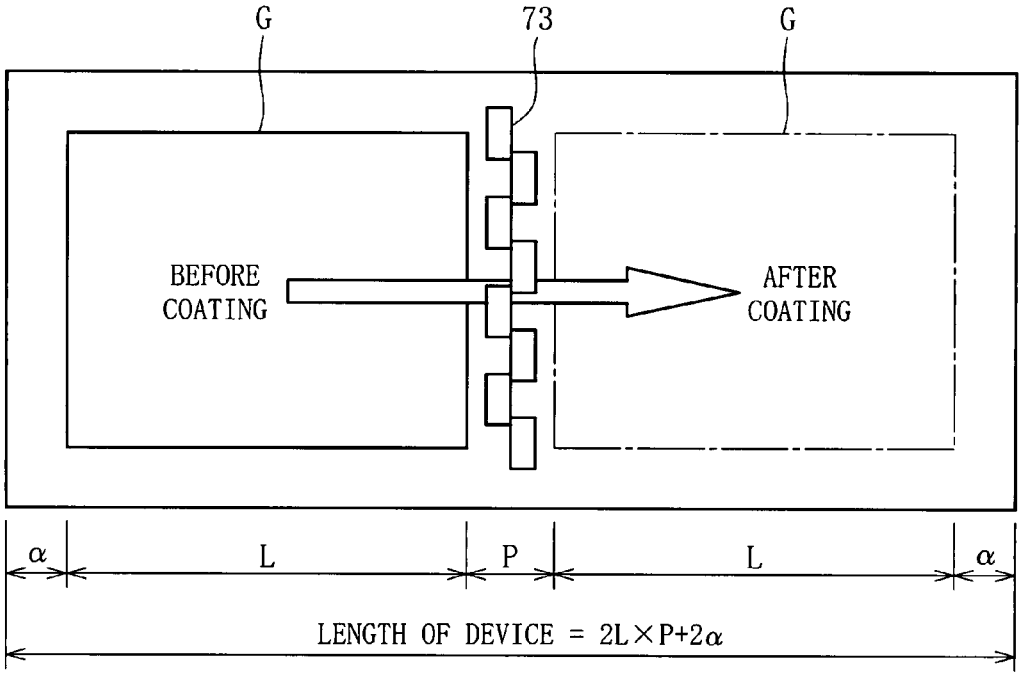

[FIG. 23] A plan diagram of a film coating device which is capable of preventing a seam from generating in a film but has no practicability because the size thereof is increased.

Figure 24:
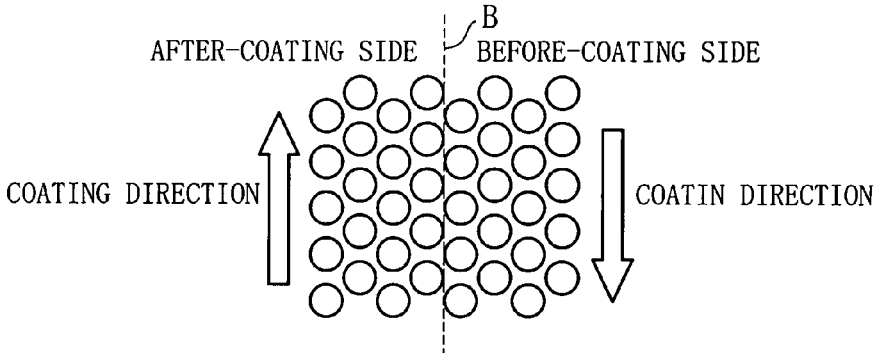

[FIG. 24] An image diagram of the seam of the film obtained by the film coating device of FIG. 22.

Figure 25:
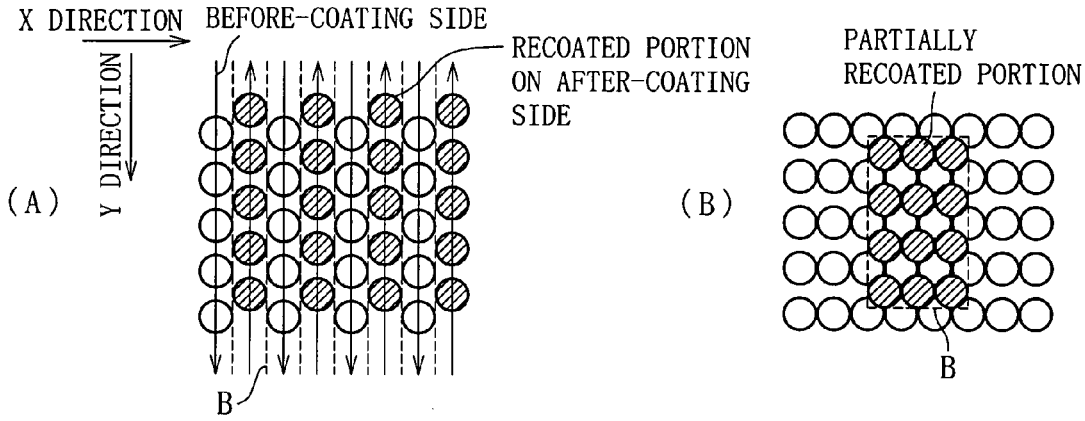

[FIG. 25] A portion (A) is an image diagram illustrating recoating using the film coating device of FIG. 22, and a portion (B) is an image diagram illustrating partial recoating using the same.

DESCRIPTION OF REFERENCE SYMBOLS

1 inkjet head (inkjet nozzle unit)
2 line-type inkjet nozzle
3 housing
4 nozzle
5 nozzle mounting surface
10 work space
11 housing fixing portion
12 camera
13 control portion
14 table
15 storage portion
16 movement operating portion
17 monitor
18 reference position
20 inkjet head (configuration in which inkjet nozzle units are arranged in series)
21 mounting shaft
22 reference plane
23 screw hole adapter
24*a* vertically extending portion of adapter
24*b* horizontally extending portion of adapter
25 groove
26, 27 side surface
28 screw hole
29, 30 screw hole
31 lower surface of mounting shaft
32, 33 screw
34 side surface of mounting shaft (side surface on opposite side of reference plane)
41 lower surface of horizontally extending portion of adapter
42 side surface of horizontally extending portion of adapter
44 mounting wall portion
45 side surface of inner side of mounting wall portion
46 upper surface of housing
47, 48, 49 screw
51 material to be coated
52 substrate
53 measuring machine
g gap
j ejection area
P1 nozzle pitch

BEST MODE FOR CARRYING OUT THE INVENTION

Hereinafter, embodiments of the present invention will be described with reference to the attached drawings.

(First Embodiment)

Figure 1:
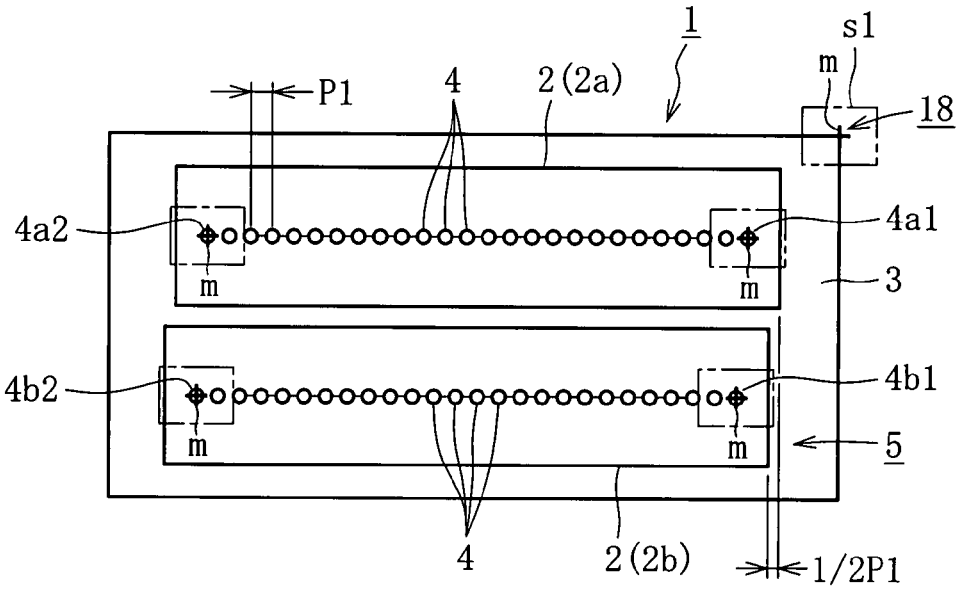
[FIG. 1] A bottom diagram illustrating a structure of an inkjet head according to a first embodiment of the present invention.

FIGS. 1 to 6 each illustrate a first embodiment of the present invention. As illustrated in FIG. 1, an inkjet head 1 according to the first embodiment includes two line-type inkjet nozzles 2*a* and 2*b*, and a housing 3 to which the line-type inkjet nozzles 2*a* and 2*b* are mounted.

The line-type inkjet nozzles 2*a* and 2*b* each include nozzles 4 that eject a liquid material and are arranged in a row at predetermined intervals. The nozzles 4 are formed at the same time when the line-type inkjet nozzles 2*a* and 2*b* are formed, thereby making it possible to produce the nozzles 4 with high precision in their shapes and positions. The line-type inkjet nozzles 2*a* and 2*b* each have a structure in which the liquid material is supplied to each of the nozzles 4 from a liquid material supplying portion (not shown), and the liquid material is ejected at a predetermined timing in response to an injection command signal sent by a controller (not shown). As a result, the line-type inkjet nozzles 2*a* and 2*b* can cause the nozzles 4 to eject the liquid material at the same timing and can cause only some selected nozzles 4 to eject the liquid material.

As illustrated in FIG. 1, the inkjet head 1 includes the two line-type inkjet nozzles 2*a* and 2*b* that are arranged in parallel with each other in the housing 3 such that positions of the nozzles 4 are shifted from each other by halved nozzle pitches P1 (½P1). It is extremely important for the inkjet head 1 to adjust a relative positional relationship between the two line-type inkjet nozzles 2*a* and 2*b* with high precision.

Figure 2:
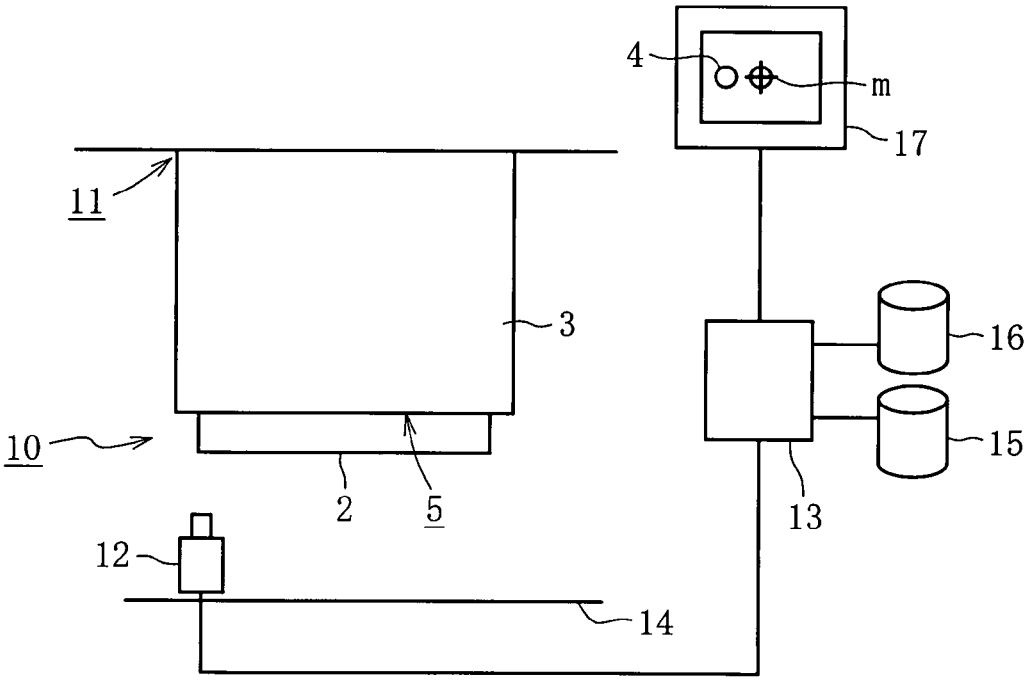
[FIG. 2] A diagram illustrating a process of mounting a line-type inkjet nozzle of the inkjet head.

In this embodiment, as illustrated in FIG. 2, in a case of mounting the line-type inkjet nozzle 2 to the housing 3, the line-type inkjet nozzle 2 is mounted to the housing 3 such that a CCD camera 12 (image taking device, camera) is disposed at a position facing a nozzle mounting surface 5, and based on an image taken by the CCD camera, the nozzles 4 of the line-type inkjet nozzles 2*a* and 2*b* are positioned.

As illustrated in FIG. 2, for example, a work space 10 for performing an assembling operation for the inkjet head 1 includes a housing fixing portion 11 for fixing the housing 3, the CCD camera 12, and a control portion 13 for controlling movement of the CCD camera 12. In FIG. 2, reference numeral 15 denotes a storage portion, 16, a movement operating portion, and 17, a monitor for displaying an image taken by the CCD camera 12.

The housing fixing portion 11 fixes the housing 3 with the nozzle mounting surface 5 of the housing 3 facing downward. The CCD camera 12 is disposed so as to move in parallel with the nozzle mounting surface 5 in a state where the CCD camera 12 faces the nozzle mounting surface 5 of the housing 3 which is fixed to the housing fixing portion 11. For example, the CCD camera 12 is installed on an XY table 14 capable of adjusting the position thereof with precision, and the position of the CCD camera 12 can be adjusted with extremely high precision with respect to the nozzle mounting surface 5.

Further, the control portion 13 sets an XY coordinate with an arbitrarily selected portion of the housing 3 being set as a reference position, and includes the storage portion 15 storing position coordinates (x1, y1), (x2, y2), (x3, y3), (x4, y4), . . . at which the arbitrarily selected portion of each of the line-type inkjet nozzles 2 is to be positioned, and the movement operating portion 16 for moving the CCD camera 12 with reference to the position coordinates stored in the storage portion 15. In the operation of moving the CCD camera 12, the CCD camera 12 may be operated by using a computer so that the CCD camera is precisely moved.

In this embodiment, the storage portion 15 sets the XY coordinate with a corner 18 on the upper right of the housing 3 of FIG. 1 being a reference position (0, 0) of the housing 3, and stores position coordinates (x1, y1), (x2, y2), (x3, y3), and (x4, y4) of nozzles 4*a*1, 4*a*2, 4*b*1, and 4*b*2 provided at both right and left ends of the each of the line-type inkjet nozzles 2*a* and 2*b*.

Next, description is given of an example of position adjustment of the line-type inkjet nozzles 2*a* and 2*b* using the above-mentioned work space 10 for performing the assembling operation for the inkjet head 1.

In the position adjustment for the line-type inkjet nozzles 2*a* and 2*b*, the line-type inkjet nozzles 2*a* and 2*b* are first installed at predetermined mounting positions on the nozzle mounting surface 5 of the housing 3 without precisely performing the position adjustment. In this embodiment, the housing 3 is mounted in the work space 10 with the nozzle mounting surface 5 facing downward, and the line-type inkjet nozzles 2*a* and 2*b* are temporarily fixed so that the nozzles are not to be dropped from the nozzle mounting surface 5 in a state where the position thereof can be finely adjusted.

The position adjustment for the line-type inkjet nozzles 2*a* and 2*b* is performed by adjusting the positions of the nozzles 4*a*1, 4*a*2, 4*b*1, and 4*b*2 provided at both the right and left ends of the each of the line-type inkjet nozzles 2*a* and 2*b* with reference to the position coordinates (x1, y1), (x2, y2), (x3, y3), and (x4, y4) that are stored in the storage portion 15.

In this embodiment, on the image displayed on the monitor 17, the image taken by the CCD camera 12 is overlapped, and a mark m (for example, cross mark) indicating the photographing center is displayed at the center of the image.

The CCD camera 12 is moved to a position where the photographing center of the CCD camera 12 and the reference position of the housing 3 (in this embodiment, as illustrated in FIG. 1, the corner 18 on the upper right of the housing 3) are overlapped with each other. Then, while an image of an area s1 containing the reference position 18 of the housing 3, which is picked up by the CCD camera 12, is being viewed, the XY table 14 is operated to move the CCD camera 12 so that the mark m indicating the photographing center of the CCD camera 12 is overlapped with the reference position 18 of the housing 3. Note that, determination as to whether the reference position 18 of the housing 3 matches the mark m indicating the photographing center of the CCD camera 12 may be made by, for example, causing a computer to recognize the reference position 18 of the housing 3 through image processing, and causing the computer to determine that the reference position 18 of the housing 3 matches the mark m indicating the photographing center of the CCD camera 12.

Thus, the position where the reference position of the housing 3 matches the photographing center of the CCD camera 12 is set as a coordinate origin of the XY table 14. In this embodiment, the upper right corner of the housing 3 is set as the reference position 18 of the housing 3 and the XY coordinate is determined with reference to the position. However, the reference position 18 of the housing 3 may be set to an arbitrary position on the nozzle mounting surface 5 of the housing 3.

Next, by the control portion 13, the CCD camera 12 is moved with reference to the position coordinates, which are stored in the storage portion 15, for the nozzles 4 of the line-type inkjet nozzle 2*a* and 2*b*.

In this embodiment, based on the data of the position coordinates of the nozzles, which are stored in the storage portion 15, the CCD camera 12 is moved to the position (x1, y1) where the nozzle 4*a*1, which is provided at the right end of the line-type inkjet nozzle 2*a*, is to be positioned. In this case, the mark m indicating the photographing center of the CCD camera 12 indicates the position (x1, y1) where the nozzle 4*a*1, which is provided at the right end of the line-type inkjet nozzle 2*a*, is to be positioned. Then, the CCD camera 12 thus moved is fixed so that the nozzle 4*a*1 provided at the right end of the line-type inkjet nozzle 2*a*, which is appropriately installed at the predetermined mounting position of the housing 3, is displayed on the image taken by the CCD camera 12. After that, the position of the line-type inkjet nozzle 2*a* is adjusted so that the center of the nozzle 4*a*1 provided at the right end of the line-type inkjet nozzle 2*a* matches the center of the mark m indicating the photographing center of the CCD camera 12.

In this embodiment, image recognition means is caused to recognize a circle shape of the nozzle 4*a*1, to thereby calculate the center position of the nozzle 4*a*1. Then, while the monitor 17 is being viewed, the position of the line-type inkjet nozzle 2 which is appropriately disposed at the predetermined mounting position of the housing 3 is finely adjusted so that the center position of the nozzle 4*a*1 matches the center of the mark m indicating the photographing center of the CCD camera 12. Note that a coordinate of the center position of the nozzle 4*a*1 in an XY coordinate system with reference to the reference position 18 of the housing 3 may be calculated, the monitor 17 may be caused to display the coordinate of the center position of the nozzle 4*a*1, and the position of the line-type inkjet nozzle 2 may be finely adjusted so that the coordinate of the center position of the nozzle 4*a*1 matches the position (x1, y1) where the center of the nozzle 4*a*1 is to be positioned, while coordinate values displayed on the monitor 17 are being viewed.

As a result, the center of the nozzle 4*a*1 provided at the right end of the line-type inkjet nozzle 2*a* can be adjusted to the position (x1, y1) where the center thereof is to be positioned. The position of the nozzle 4*a*2 provided at a left end of the line-type inkjet nozzle 2*a* is adjusted in the same manner.

The positions of the nozzles 4*a*1 and 4*a*2, which are provided at both the right and left ends of the line-type inkjet nozzle 2*a*, are adjusted to the positions (x1, y1) and (x2, y2) where the nozzles are to be positioned at the same time, to thereby fix the line-type inkjet nozzle 2*a* to the housing 3. Accordingly, for example, the nozzles 4*a*1 and 4*a*2, which are provided at both the right and left ends of the line-type inkjet nozzle 2*a*, may be simultaneously photographed using two CCD cameras 12, to thereby adjust the position of the line-type inkjet nozzle 2*a*.

Further, also with regard to the line-type inkjet nozzle 2*b*, the positions of the nozzles 4*b*1 and 4*b*2 provided at both the right and left ends of the line-type inkjet nozzle 2*b*, are adjusted to the positions (x3, y3) and (x4, y4) where the nozzles are to be positioned at the same time, to thereby mount the line-type inkjet nozzle 2*b* to the predetermined position of the housing 3 with high precision.

In this manner, the two line-type inkjet nozzles 2*a* and 2*b* can be arranged in parallel with each other such that the positions of the nozzles 4 are shifted from each other by a half of the nozzle pitch P1 (½ pitch) with high precision. The inkjet head 1 in which the line-type inkjet nozzles 2 are arranged in the above-mentioned manner as a whole has a state equivalent to a state where the nozzles 4 are arranged with halved nozzle pitches (½P1) of one line-type inkjet nozzle 2. Accordingly, in a case where the nozzle pitch P1 of the line-type inkjet nozzles 2 is reduced to the limit, the nozzle pitch of the inkjet head 1 as a whole can be further reduced to a half of the nozzle pitch.

Further, in the inkjet head 1, an ejection timing of the liquid material can be adjusted for each line-type inkjet nozzle 2. As a result, adjustment of a dot pitch for fine coating, rough coating, and the like can be performed with ease. For example, when the liquid material is ejected only from one line-type inkjet nozzle 2, the nozzle pitch of the inkjet head 1 as a whole becomes the nozzle pitch P1 of one line-type inkjet nozzle 2*a*. In addition, if the liquid material is ejected from the two line-type inkjet nozzles 2*a* and 2*b* at the predetermined timing, the inkjet head 1 as a whole can eject the liquid material with a narrow nozzle pitch (½ p1).

Description has been given of, in the above embodiment, the inkjet head 1 in which the two line-type inkjet nozzles 2 including the nozzles 4, which eject the liquid material and are arranged in a row, are arranged in parallel with each other such that the positions of the nozzles 4 are shifted from each other by ½ of the nozzle pitch P1. The number n of the inkjet nozzles 2 to be arranged in parallel with each other can be arbitrarily increased.

For example, though not shown in the drawings, when three line-type inkjet nozzles 2 are arranged in parallel with each other such that the positions of the nozzles 4 are shifted from each other by ⅓ of the nozzle pitch P1, the nozzle pitch of the inkjet head as a whole can be set to ⅓ of the nozzle pitch P1 of the line-type inkjet nozzle 2. Alternatively, when four line-type inkjet nozzles 2 are arranged in parallel with each other such that the positions of the nozzles 4 are shifted from each other by ¼ of the nozzle pitch P1, the nozzle pitch of the inkjet head as a whole can be set to ¼ of the nozzle pitch P1 of the line-type inkjet nozzle 2. Similarly, when n number of line-type inkjet nozzles 2 are arranged in parallel with each other such that the positions of the nozzles 4 are shifted from each other by 1/n of the nozzle pitch P1, the nozzle pitch of the inkjet head as a whole can be set to 1/n of the nozzle pitch P1 of the line-type inkjet nozzle 2.

Thus, when the number n of the line-type inkjet nozzles 2 to be arranged in parallel with each other is further increased, the nozzle pitch of the inkjet head as a whole can be further made smaller. Note that when the number n of the line-type inkjet nozzles 2 to be arranged in parallel with each other is further increased, a distance between a top line-type inkjet nozzle of the line-type inkjet nozzles 2 to be arranged in parallel with each other, and a bottom line-type inkjet nozzle thereof becomes larger. For this reason, in a case of using the line-type inkjet nozzle (for example, use for forming an orientation film) where there arise a problem of a fusion failure of the ejected liquid material, the number n of the line-type inkjet nozzles to be arranged in parallel with each other may be adjusted so as not to raise the problem. In the present circumstances, for those uses, it seems appropriate that the number n of the line-type inkjet nozzles to be arranged in parallel with each other is set to about 4 or 5 or smaller.

Next, assuming that the inkjet head 1 including the line-type inkjet nozzles 2 which are arranged in parallel with each other corresponds to an inkjet nozzle unit, description is given of an inkjet head including the inkjet nozzle units which are assembled in series.

Figure 3:
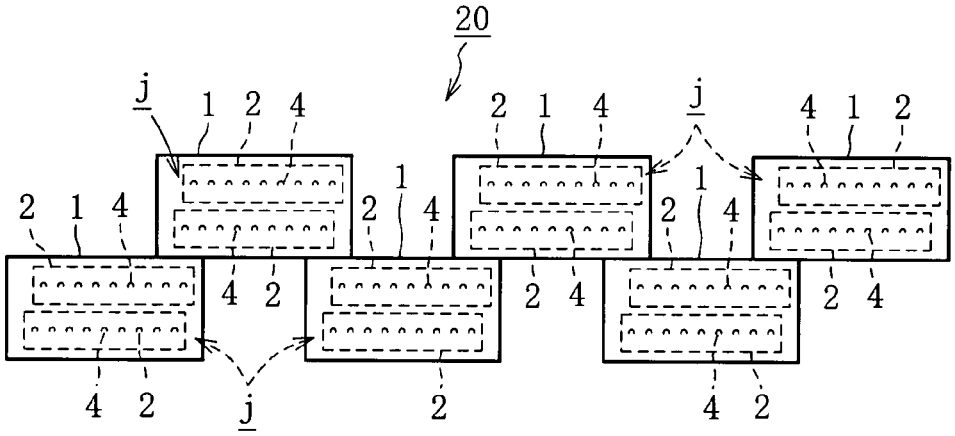
[FIG. 3] A plan diagram illustrating an arrangement position of inkjet nozzle units of an inkjet head according to a modified example.

As illustrated in FIG. 3, an inkjet head 20 includes inkjet nozzle units 1 which are arranged in series such that both right and left ends of an ejection area j for the liquid material of the inkjet nozzle units 1 are continuously formed with another ejection area j for the liquid material of the adjacent inkjet nozzle unit 1.

Figure 4:
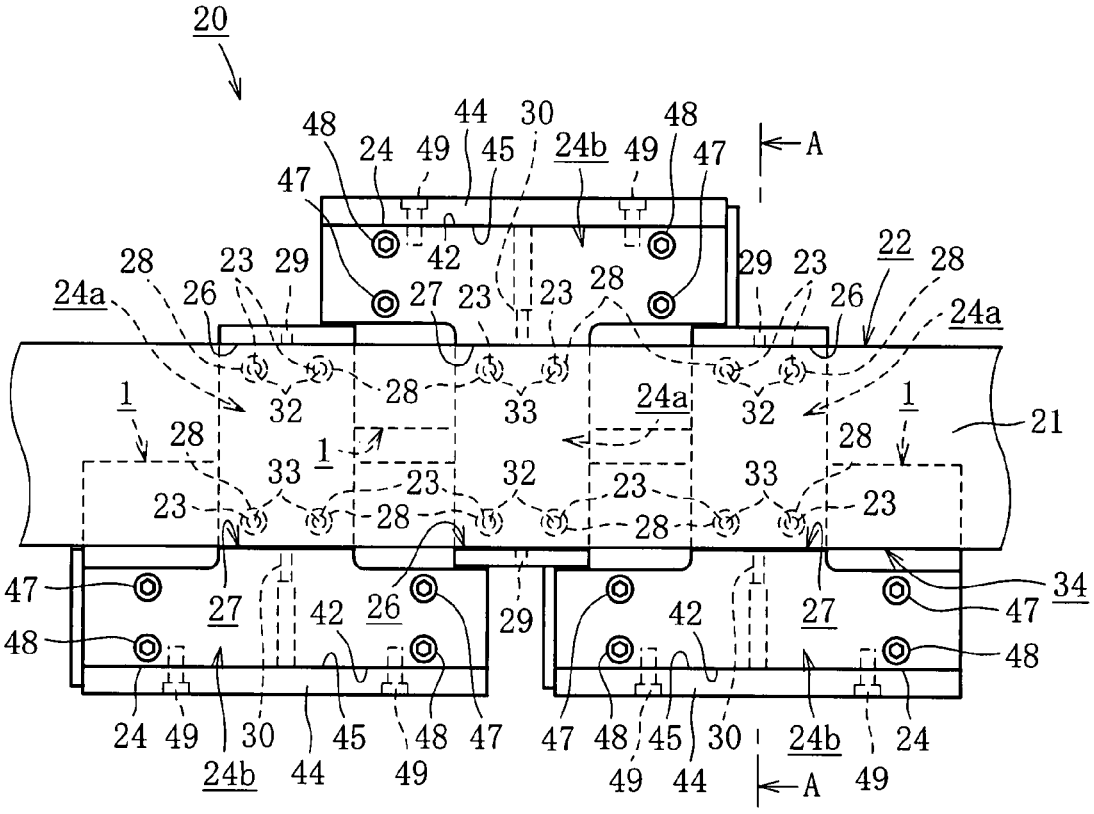
[FIG. 4] A plan diagram illustrating a mounting structure (position adjustment) for inkjet nozzle units of an inkjet head according to a modified example.

In this embodiment, as illustrated in FIG. 4, on both sides of a mounting shaft 21 in a width direction of the mounting shaft 21, the inkjet nozzle units 1 are alternately arranged in a staggered manner. On one side surface (side surface on the upper side of FIG. 4) of the mounting shaft 21, a reference plane 22 is formed. The reference plane 22 secures a necessary flatness so that the inkjet nozzle units 1 are arranged with high precision. In this embodiment, the reference plane 22 secures a flatness of ±5 μm as a whole, and locally secures a flatness of ±1 μm/160 mm. Further, on a lower surface of the mounting shaft 21, screw holes 23 for mounting the inkjet nozzle units 1 (T-shaped adapter 24 to be described later of the inkjet nozzle units 1) at predetermined intervals in a longitudinal direction.

Figure 5:
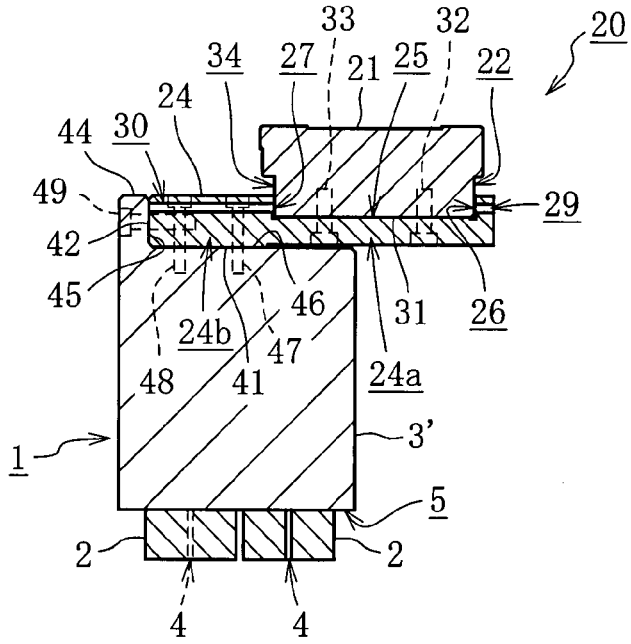
[FIG. 5] A cross-sectional diagram taken along the line A-A of FIG. 4.

As illustrated in FIGS. 4 and 5, the inkjet nozzle units 1 are mounted to the mounting shaft 21 through the adapters 24 each having a substantially T-shaped planar shape formed on an upper surface thereof. The adapters 24 are each formed with an extremely high precision. The inkjet nozzle units 1 are mounted below a horizontally extending portion 24*b* of each of the T-shaped adapters 24 so that the line-type inkjet nozzles 2 are arranged along the horizontally extending portion 24*b* of each of the T-shaped adapters 24. The inkjet nozzle units 1 are mounted at predetermined positions to the T-shaped adapter 24 with high precision. In this embodiment, the adapters 24 are mounted to the mounting shaft 21, and then, the inkjet nozzle units are mounted to the adapters 24. In general, in a case of removing the inkjet nozzle units, only the inkjet nozzle units 1 can be removed from the adapter 24 while the adapters 24 are still mounted to the mounting shaft 21.

As illustrated in FIGS. 4 and 5, the adapters 24 each have a groove 25 provided at a central portion of a vertically extending portion 24*a*, for mounting the adapters 24 to the mounting shaft 21. On both side surfaces 26 and 27 in a vertical direction of the groove 25, the flatness which is about the same as that of the reference planar surface 22 of the mounting shaft 21 is secured. On a bottom surface of the groove 25, screw holes 28 for mounting screws so as to correspond to the screw holes 23 of the mounting shaft 21 are formed. The screw holes 28 are each obtained by forming a hole with a large diameter with respect to the diameter of the screw to be mounted so that the relative positional relationship between the mounting shaft 21 and the adapter 24 can be finely adjusted. On both sides of the groove 25, there are provided screw holes 29 and 30 for mounting screws (not shown) for pressing the side surface (26 or 27) of the adapter 24 onto the reference plane 22 in the vertical direction.

In the case of mounting the adapters 24 to the mounting shaft 21, as illustrated in FIG. 5, the groove 25 of the adapter 24 is fitted with the lower surface 31 of the mounting shaft 21, and the vertically extending portion 24*a* of the T-shaped adapter 24 is mounted to the mounting shaft 21 orthogonally to the mounting shaft 21. Then, as illustrated in FIG. 4, the adapters 24 are fixed to the mounting shaft 21 by being positioned on the reference plane 22 of the mounting shaft 21.

In this embodiment, one side surface (26 or 27) of the groove 25 of the T-shaped adapter 24 is pressed against the reference plane 22 of the mounting shaft 21 in advance, and the adapters 24 are mounted to the mounting shaft 21 with high precision, thereby securing the mounting precision of the inkjet nozzle unit 1 with respect to the mounting shaft 21.

In the case of mounting the adapter 24, for example, the groove 25 of the T-shaped adapter 24 is fitted with the lower surface 31 of the mounting shaft 21, screws 32 and 33 are mounted from the lower surface side of the adapter 24 in this state, and the adapter 24 is loosely fixed (temporarily fixed) to the mounting shaft 21. On a side of a side surface 34 which is an opposite side of the reference plane 22 of the mounting shaft 21, a screw (not shown) is mounted in the screw hole (29 or 30) of the side surface (26 or 27) of the groove 25, the screw is screwed, and the leading edge of the screw is pressed against the side surface 34 of the mounting shaft 21. As a result, on the side of the reference plane 22 of the mounting shaft 21, the side surface (27 or 26) of the groove 25 and the reference plane 22 are brought into contact with each other, and the T-shaped adapters 24 are set orthogonal to the mounting shaft 21 with high precision, thereby fixing the adapters 24 of the mounting shaft 21 with the screws 32 and 33. Thus, the adapters 24 can be fixed to the mounting shaft 21 in a sate where the vertically extending portions 24*a* of the T-shaped adapters 24 are set orthogonal to the mounting shaft 21 with high precision.

Specifically, in the adapter 24 illustrated in FIG. 5, of the side surfaces 26 and 27 of the groove 25, the side surface 26 on the leading edge side of the vertically extending portion 24*a* of each of the T-shaped adapters faces the reference plane 22 of the mounting shaft 21. In this case, the leading edge of a screw (not shown) to be screwed into the screw hole 30 on a proximal end side of the left side of the figure is pressed against the side surface 34 of the mounting shaft 21, thereby bringing the side surface 26 on the right side of the figure into contact with the reference plane 22 of the mounting shaft 21.

Though not shown in the drawings, of the side surfaces 26 and 27 of the groove 25 of the adapter 24, when the side surface 27 on the proximal end of the vertically extending portion 24*a* of each of the T-shaped adapters faces the reference plane 22 of the mounting shaft 21 (when left-hand and right-hand of FIG. 5 are opposite to each other), a screw is screwed into the screw hole 29 on the leading edge side, the leading edge of the screw may be pressed against the side surface 34 of the mounting shaft 21, and the side surface 27 on the proximal end side of the adapters 24 may be pressed against the reference plane 22 of the mounting shaft 21.

Thus, in this embodiment, the reference plane 22 is formed on one side surface of the mounting shaft 21, and all the adapters 24 are mounted to be positioned on the reference plane 22. As a result, when the flatness of the reference plane 22 of the mounting shaft 21 is secured with high precision, all the adapters 24 can be mounted with high precision, thereby easily securing the precision in mounting the adapters 24.

Next, description is given of a method of mounting the inkjet nozzle units 1 to the adapters 24 which are mounted to the mounting shaft 21 with high precision in the manner as described above. In the case of mounting the inkjet nozzle units 1 to the adapters 24, in the same manner as in the case of the mounting the adapters 24, it is necessary to secure a high mounting precision.

In this embodiment, the inkjet nozzle units 1 are to be mounted to a lower portion of the horizontally extending portion 24*b* of the adapter 24 to be mounted. In order to secure the above-mentioned high mounting precision, a lower surface 41 and a side surface 42 of the horizontally extending portion 24*b* of the adapter 24 are processed with high precision.

Specifically, the side surface 42 of the horizontally extending portion 24*b* of the adapter 24 is formed so as to be in parallel with the side surfaces 26 and 27 of the groove 25 of the adapter 24, and the lower surface 41 of the horizontally extending portion 24*b* of the adapter 24 is formed with high precision so as to orthogonally extend with respect to the side surface 42 of the horizontally extending portion 24*b*. Further, the lower surface 41 and the side surface 42 of the horizontally extending portion 24*b* of the adapter 24 are formed with the flatness which is about the same as that of the reference plane of the mounting shaft 21.

In addition, as illustrated in FIG. 5, a housing 3' of the inkjet nozzle unit 1 has a mounting wall portion 44, which vertically rises, on a side edge portion of an upper portion (surface on an opposite side of the nozzle mounting surface 5) of the housing 3', and a side surface 45 on an inner side of the mounting wall portion 44 and an upper surface 46 of the housing 3' are each processed with high precision.

Specifically, the side surface 45 on the inner side of the mounting wall portion 44 is formed so as to orthogonally extend with respect to the upper surface 46 of the housing 3', and the side surface 45 on the inner side of the mounting wall portion 44 and the upper surface 46 of the housing 3' are each formed with the flatness which is about the same as that of the reference plane 22.

In the case of mounting the inkjet nozzle units 1 to the adapters 24, first, as illustrated in FIG. 5, the upper surface 46 of the housing 3' and the side surface 45 on the inner side of the mounting wall portion 44 of the inkjet nozzle unit 1 are pressed against the lower surface 41 and the side surface 42 of the horizontally extending portion 24*b* of the adapter 24, respectively. Next, the housing 3' of the inkjet nozzle unit 1 is loosely fixed (temporarily fixed) to the adapter 24 with screws 47 and 48 mounted in the horizontally extending portion 24*b* of the adapter 24.

Next, the side surface 45 of the mounting wall portion 44 is loosely fastened with a screw 49 mounted from the outside of the mounting wall portion 44 of the housing 3' so that the side surface 42 of the horizontally extending portion 24*b* of the adapter 24 is abutted against the side surface 45 of the mounting wall portion 44. While the position of the housing 3' in the horizontal direction with respect to the adapter 24 is adjusted, the screws 47, 48, and 49 are alternately fastened, thereby fixing the inkjet nozzle unit 1 to the adapter 24. Thus, in this embodiment, in the state where the upper surface 46 of the housing 3' and the lower surface 41 of the horizontally extending portion 24*b* of the adapter 24, and the side surface 45 on the inner side of the mounting wall portion 44 and the side surface 42 of the horizontally extending portion 24*b* of the adapter 24 are pressed against each other, respectively, the housing 3' of the inkjet nozzle unit 1 is fixed, thereby securing the precision in mounting the inkjet nozzle unit 1 to the adapter 24.

With the method of mounting the inkjet nozzle unit 1 according to this embodiment, generally, when the inkjet nozzle unit 1 is to be removed, in a state where the adapter 24 remains to be mounted to the mounting shaft 21, only the inkjet nozzle unit 1 can be removed from the adapter 24. In the case of mounting the inkjet nozzle unit 1 to the adapter 24, when the screws 47, 48, and 49 are alternately fastened to thereby fix the inkjet nozzle unit 1 to the adapter 24 in the manner as described above, the inkjet nozzle unit 1 can be mounted with high precision. Accordingly, mounting and dismounting of the inkjet nozzle unit 1 can be easily performed.

Next, description is given of adjustment of a gap g (see FIG. 6) between the inkjet nozzle unit 1 and a material to be coated 51 on which a liquid material is to be coated. When the gap g is extremely large, a flying curve is more likely to occur. Further, when the gap is extremely narrow, a liquid pool accumulated on the lower surface of the inkjet nozzle unit 1 is brought into contact with the material to be coated 51. For this reason, a lower limit of the gap g is adjusted to a predetermined value of 0.5 mm or larger (more preferably 0.7 mm or larger), and an upper limit of the gap g is adjusted to a predetermined value of 1.2 mm or smaller (more preferably 1.0 or smaller).

Figure 6:
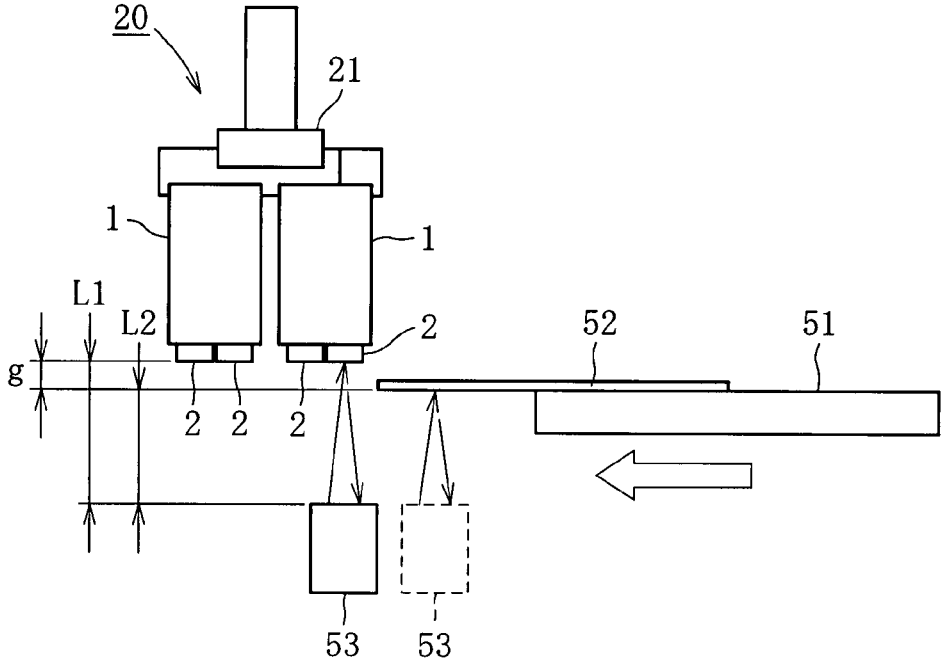
[FIG. 6] A side diagram illustrating a mounting structure (height adjustment) of the inkjet nozzle units of the inkjet head according to the modified example.

In this embodiment, in the case of adjusting the gap g, as illustrated in FIG. 6, on the upper surface of the material to be coated 51, a substrate 52 (glass substrate) is placed so that an end portion thereof protrudes from the material to be coated 51. Further, a measuring machine 53 is provided so as to be opposed to the surface on which the nozzles 4 of the inkjet nozzle unit 1 are arranged. In this embodiment, as the measuring machine 53, an optical measuring machine (laser measuring machine) is used so that distance measurement can be precisely performed. By using the measuring machine 53, a distance L1 between the measuring machine 53 and a nozzle surface of the inkjet nozzle unit 1 is measured. Then, the substrate 52 placed on the material to be coated 51 is allowed to enter above the measuring machine 53, and a distance L2 between the measuring machine 53 and the lower surface of the substrate 52 is measured. The gap g between the nozzle surface of the line-type inkjet nozzle 2 and the upper surface of the material to be coated 51 is a difference between the distance L1 and the distance L2 ($g=L1-L2$). Then, the height of the mounting shaft 21 to which the inkjet nozzle units 1 are mounted may be adjusted such that the measured gap g becomes a predetermined gap value.

As a result, the gap g can be adjusted with high precision, control for an impact position of the liquid material ejected from each of the nozzles 4 of the inkjet nozzle unit 1 can be easily performed, and the liquid pool can be prevented from being adhered to the material to be coated.

As described above, in the inkjet head unit 20, the n number of line-type inkjet nozzles 2 which include the nozzles 4 that eject the liquid material and are arranged in a row, and which are arranged in parallel with each other such that the positions of the nozzles 4 are shifted from each other by 1/n of the nozzle pitch p1, are used as the inkjet nozzle unit. Accordingly, the nozzle pitch of the line-type inkjet nozzle 2 as a whole can be narrowed. In addition, in the inkjet head 20, the ejection timing for the liquid material of each line-type inkjet nozzle 2 of the inkjet nozzle units 1 can be adjusted. As a result, the adjustment of the dot pitch can be performed and the adjustment such as fine coating and rough coating can be easily performed.

Then, as described above, when the plurality of inkjet nozzle units 1 are mounted to the mounting shaft 21 with high precision, an area in which the liquid material can be coated at one time can be secured, and the process speed can be improved.

In the inkjet head 20 according to this embodiment, when the liquid material ejected from the inkjet head 20 is used as a material of an orientation film, and when the material to be coated on which the orientation film material is to be coated is, for example, a liquid crystal device substrate, a length corresponding to the width of the liquid crystal device substrate is secured as the length of the mounting shaft 21, and the inkjet nozzle units 1 can be arranged so that the inkjet nozzle units 1 face the entire width of the liquid crystal device substrate.

As a result, in a case of coating the orientation film material on the liquid crystal device substrate, the coating can be performed at a time, and the film thickness of the orientation film material can be made uniform and the process speed can be improved. Thus, the inkjet head has a structure in which, assuming that the inkjet head which includes the line-type inkjet nozzles that are arranged in parallel with each other, as one inkjet nozzle unit, and the inkjet nozzle units are assembled in series. As a result, the adjustment of the nozzle pitch and the dot pitch can be easily performed. When the inkjet nozzle units are arranged in series with the necessary length, the liquid material can be coated uniformly, and the process speed becomes higher. Accordingly, the inkjet head is particularly suitable for an inkjet head for an orientation film forming device, which is required to secure the uniformity in film thickness by fusing the coated liquid material without causing unevenness.

In the above, the inkjet head according to the first embodiment of the present invention has been described, but the present invention is not limited to the above-mentioned embodiment. For example, each shape of the components such as the housing 3, the mounting shaft 21, and the adapter 24, each mutual mounting structure among the components, and the like can be modified in various manners.

(Second Embodiment)

Figure 7:
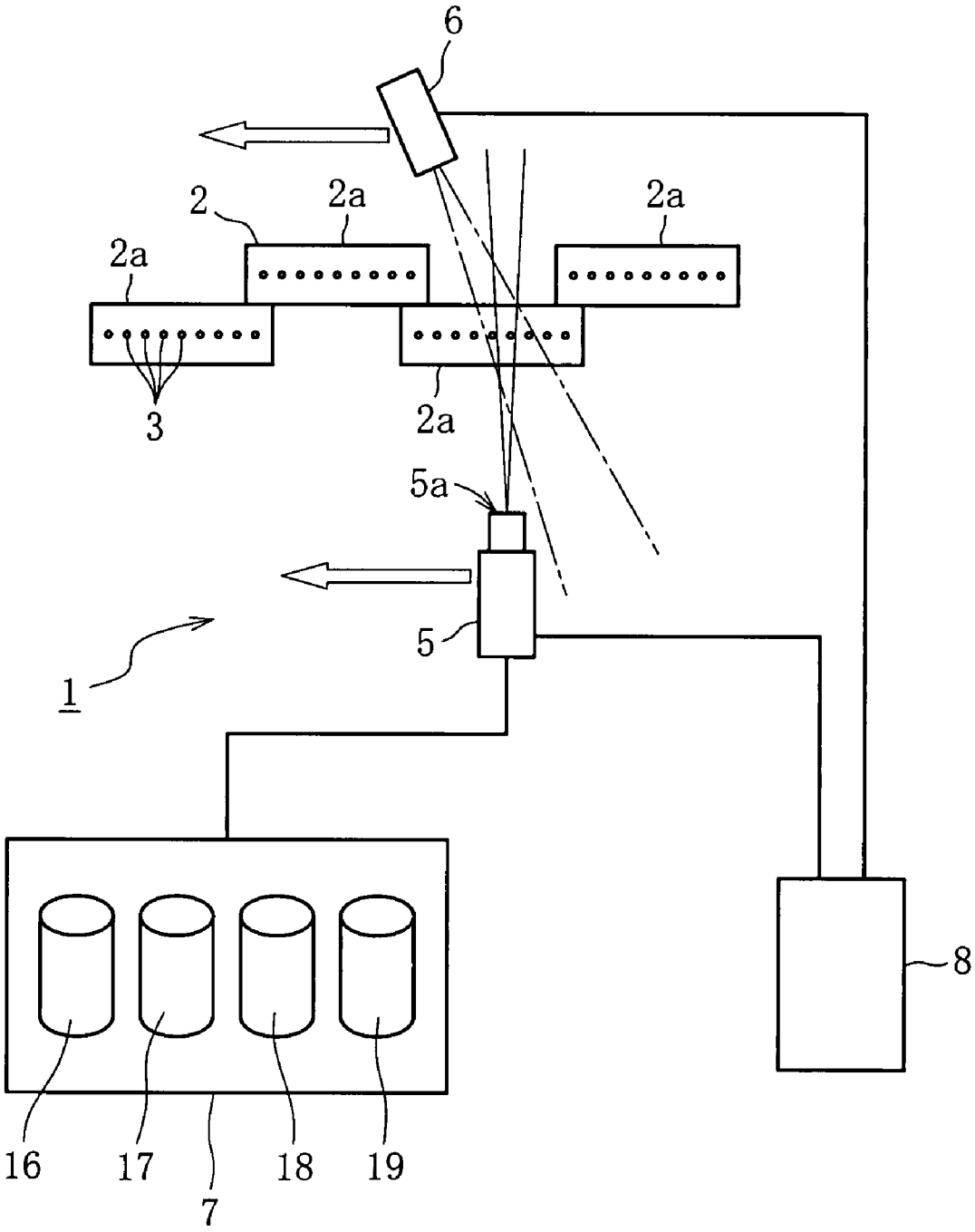
[FIG. 7] A plan diagram illustrating a structure of an ejection abnormality detecting device according to a second embodiment of the present invention.
Figure 8:
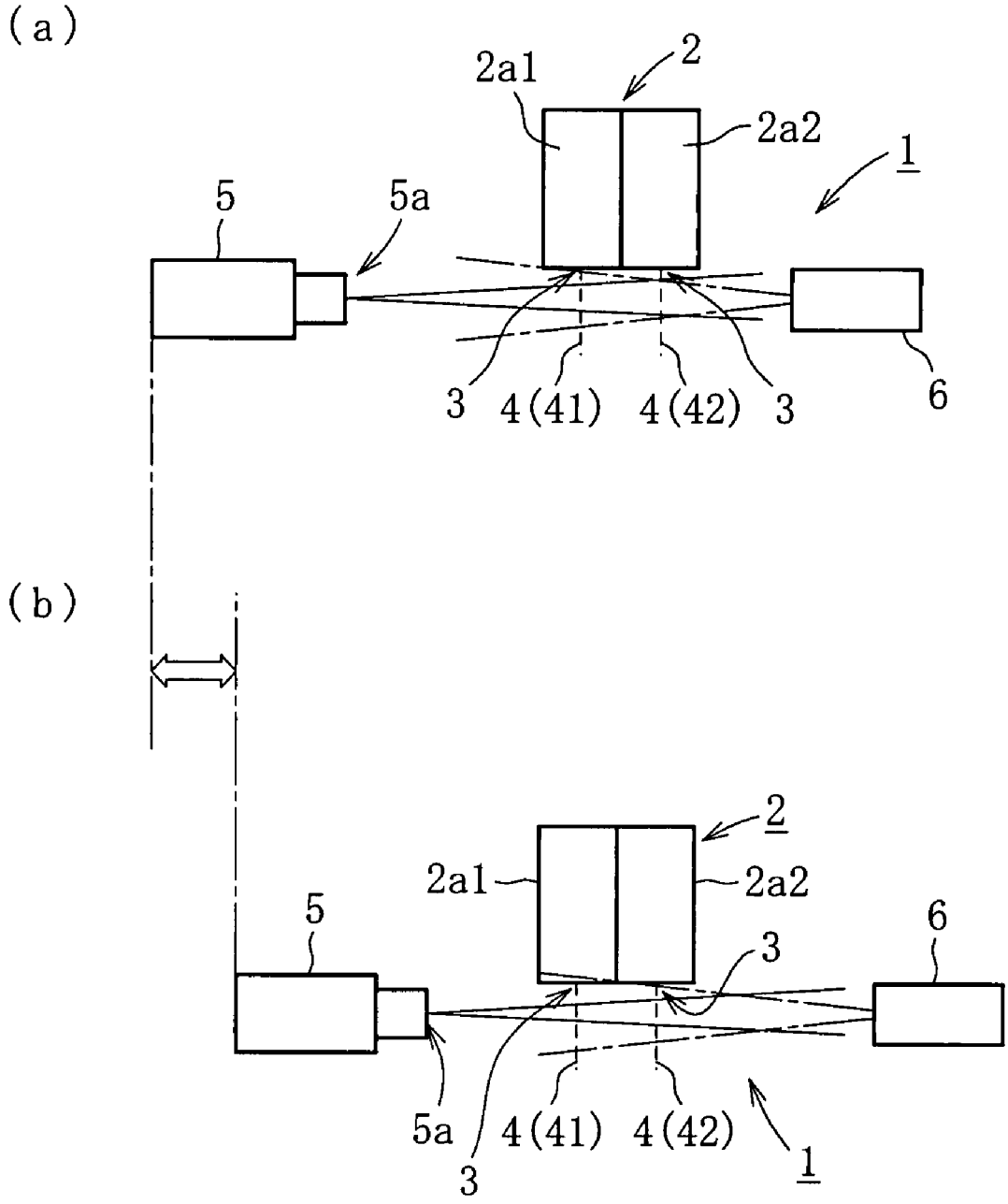
[FIG. 8] Portions (a) and (b) are side diagrams of the ejection abnormality detecting device.

FIG. 7 toll each illustrate a second embodiment of the present invention. As illustrated in FIGS. 7 and 8(*a*), an ejection abnormality detecting device 1 for an inkjet head according to the second embodiment includes a camera 5 for photographing a liquid material 4 ejected from nozzles 3 of an the inkjet head 2, a light source 6 for illuminating light necessary for photographing, and an ejection abnormality detecting portion 7 for processing an image taken by the camera 5 to detect an ejection abnormality. Note that, in this embodiment, as illustrated in FIG. 7, the inkjet head 2 has a structure in which identical inkjet heads 2*a* including the nozzles 3 that are arranged in series such that positions thereof are alternately shifted from each other in the longitudinal direction in a staggered manner.

As illustrated in FIG. 7, the camera 5 is disposed so as to be capable of photographing the liquid material 4 (see FIG. 8(*a*)) ejected from the inkjet head 2, from the direction orthogonal to an ejecting direction of the inkjet head 2. Focusing of the camera is set so that the liquid material 4 is focused when the liquid material 4 is normally ejected from the inkjet head 2.

Figure 9:
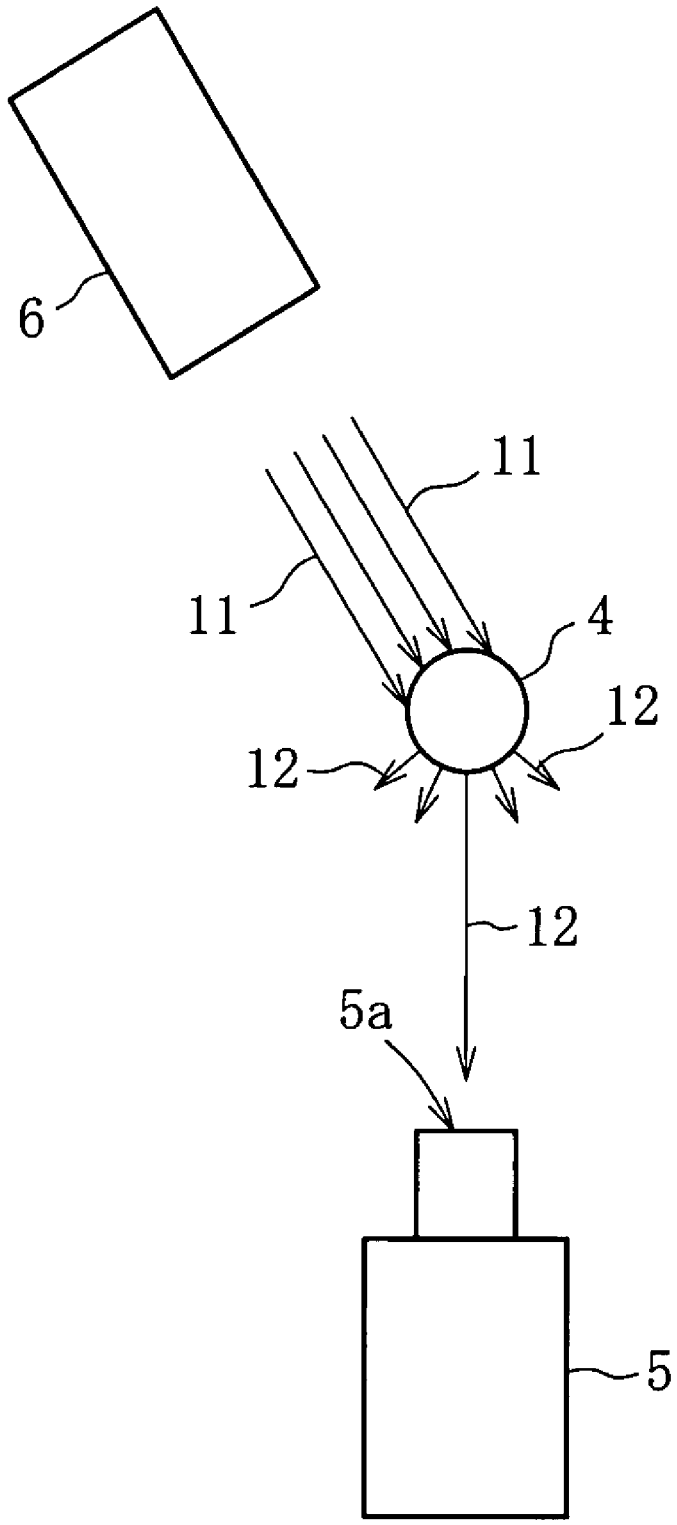
FIG. 9 A plan diagram illustrating a positional relationship between a camera and a light source of the ejection abnormality detecting device.

The light source 6 is disposed on the opposite side of the camera 5 through the liquid material 4, the light source 6 is not diametrically opposed to the camera 5 so that light (direct light) illuminated from the light source 6 does not directly enter a finder 5*a* of the camera 5, and light is illuminated obliquely with respect to a photographing direction of the camera 5 by slightly shifting the position of the light source 6 horizontally, obliquely, or vertically from a position diametrically opposite to the camera 5. As a result, as illustrated in FIG. 9, the light illuminated from the light source 6 (direct light 11) enters the finder 5*a* of the camera 5 as light (reflected light 12) reflected by the liquid material 4.

Figure 10:
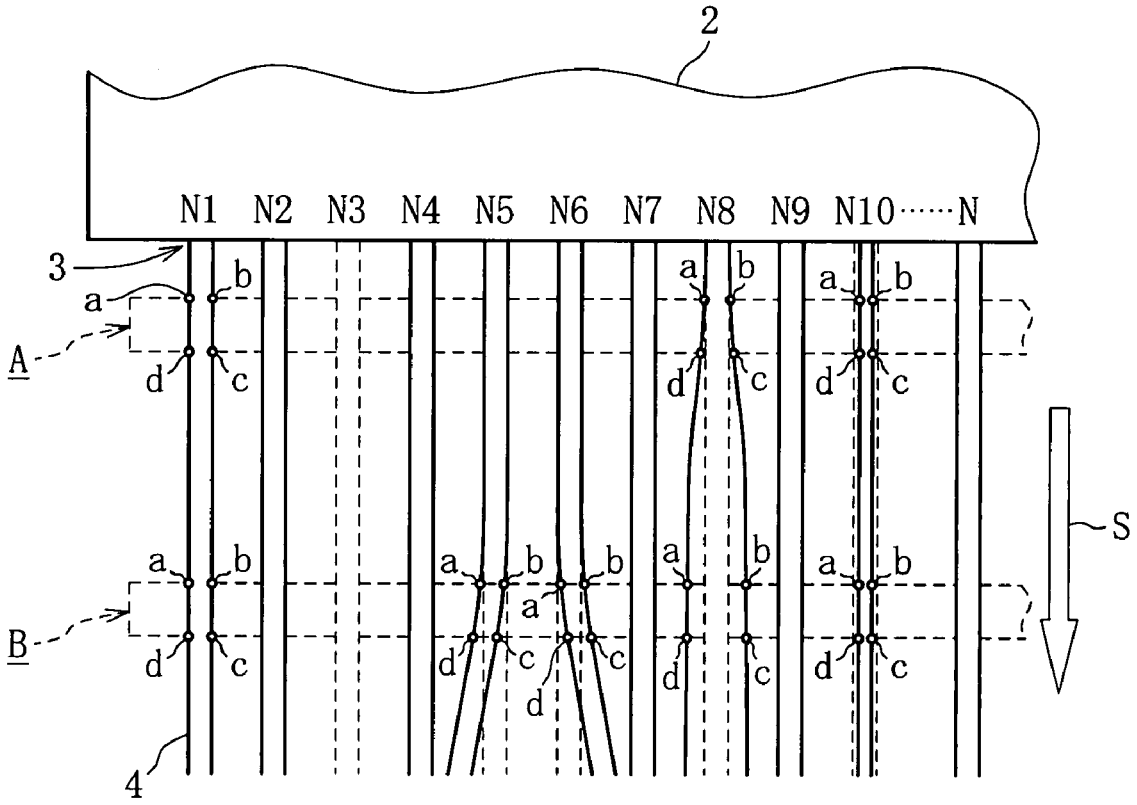
[FIG. 10] A side diagram illustrating a method of determining an ejection abnormality of the ejection abnormality detecting device.
Figure 11:
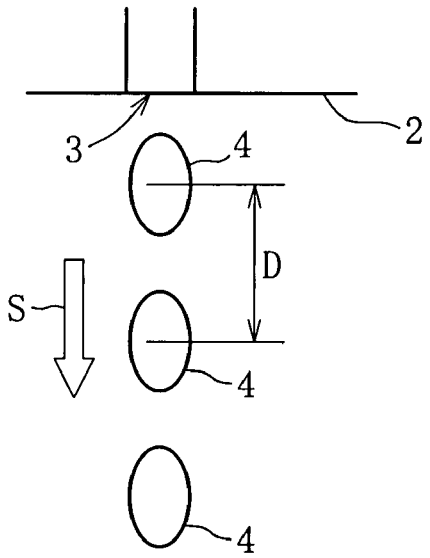

With the above-mentioned structure, when the light is illuminated from the light source 6 to photograph the liquid-type material 4 using the camera 5, the speed of ejecting the liquid droplets is high, so, as illustrated in FIG. 10, the liquid material 4 can be seen as liquid columns. Note that when momentary light is illuminated from the light source 6 and the liquid-type material 4 is photographed using the camera 5, the liquid material 4 can be photographed as in a state of liquid droplets as illustrated in FIG. 11.

Further, in this embodiment, as illustrated in FIG. 7, there is provided a control portion 8 for relatively moving the camera 5 and the light source 6 with respect to the inkjet head 2.

Focusing of the camera 5 is controlled such that the liquid material 4 is constantly focused on the camera 5 according to the relative movement of the camera 5 and the light source 6, assuming that the liquid material 4 is normally ejected from the nozzles 3.

In this embodiment, as illustrated in FIG. 8(*b*), the control portion 8 controls the positional relationship between the camera 5 and the light source 6 with respect to the nozzles 3 so that the liquid material 4 is constantly focused on the camera 5 according to the relative movement of the camera 5 and the light source 6, assuming that the liquid material 4 is normally ejected from the nozzles 3. Specifically, in this embodiment, in a case of photographing the liquid material 4 ejected from a single inkjet head 2*a*2 provided on the right side of the figure, as compared to a case of photographing the liquid material 4 ejected from an inkjet head 2*a*1 provided on the left side of the figure, the camera 5 and the light source 6 are moved to right. In a case of photographing the liquid material 4 ejected from the single inkjet head 2*a*2 provided on the left side of the figure, the camera 5 and the light source 6 are moved to left, to the contrary.

Note that FIG. 8(*a*) illustrates positions of the camera 5 and the light source 6 in the case of photographing a liquid material 41 ejected from the single inkjet head 2*a*1 provided on the left side of the figure with respect to the inkjet head 2. In addition, FIG. 8(*b*) illustrates positions of the camera 5 and the light source 6 in the case of photographing a liquid material 42 ejected from the single inkjet head 2*a*2 provided on the right side of the figure with respect to the inkjet head 2.

As illustrated in FIG. 7, based on the image of the liquid material 4 picked up by the camera 5, the ejection abnormality detecting portion 7 calculates the position or a liquid width of the liquid material 4 at least two positions in the ejecting direction of the nozzle 3, and compares the positions or liquid widths of the liquid material 4 obtained when the liquid material 4 is normally ejected from the nozzles 3, at the positions where the position or the liquid width of the liquid material 4 is calculated, thereby detecting the ejection abnormality of the nozzles 3.

In this embodiment, the ejection abnormality detecting portion 7 includes an image storage portion 16 for storing images picked up by the camera 5, a calculation portion 17 for calculating the position or the liquid width of the liquid material 4 at least two positions in the ejecting direction of the nozzle 3, a normal value storage portion 18 for storing normal values of the position or the liquid width of the liquid material 4 obtained when the liquid material 4 is normally ejected from the nozzle 3, and a determination portion 19 for determining the ejection abnormality of the nozzle.

Based on the images stored in the image storage portion 16, the calculation portion 17 performs binarization processing for extracting the liquid material 4, and specifies the position calculating the position or the liquid width of the liquid material 4, thereby calculating the position or the liquid width of the liquid material 4.

The binarization processing is processing in which pixels of the image stored in the image storage portion 16, are each provided with a threshold value, by focusing on characteristics of images, such as brightness and color, and the image of the liquid material 4 is extracted from the image stored in the image storage portion 16 so that the liquid material 4 can be recognized by a computer. Through the processing, the liquid material 4 photographed as the liquid columns by the camera 5 can be extracted. In a binalized image obtained by extracting the image of the liquid material 4, for example, one of the liquid material 4 and the portion excluding the liquid material 4 may be displayed as white, and the other of them may be displayed as black.

Then, at least two positions, which are distant from each other in the ejecting direction of the nozzle 3, are selected as positions used for calculating the position or the liquid width of the liquid material 4. In this embodiment, as illustrated in FIG. 10, at a position closer to the nozzle 3 and at a position far from the nozzle 3 in an ejecting direction S of the nozzle 3, two virtual blocks A and B, each of which has a predetermined width in the ejecting direction S of the nozzle 3 and extends in parallel with the lower surface of the inkjet head 2, are applied to the binalized image. Then, for each of the blocks A and B, four intersection coordinates a to d at which each of the blocks A and B and the liquid material 4 intersect each other are calculated. Then, the positions and the liquid widths of each liquid material 4 are calculated at the positions closer to the nozzle 3 and at the positions far from the nozzle 3 from each of the four intersection coordinates a to d.

The position of the liquid material 4 may be calculated, for example, for each of the blocks A and B, as a center of the four intersection coordinates a to d at which each of the blocks A and B and the liquid material 4 intersect each other (center of gravity of a square abcd depicted when each of the blocks A and B and the liquid material 4 intersect each other). The liquid width of the liquid material 4 may be calculated, for example, as a mean value of an upper side and a lower side of the square abcd depicted when each of the blocks A and B and the liquid material 4 intersect each other.

Next, the determination portion 19 determines the ejection abnormality of the inkjet head 2 based on the calculated values of the position and the liquid width of the liquid material 4 calculated by the calculation portion 17.

The normal value storage portion 18 stores threshold values for defining an appropriate range of the normal values of the position and the liquid width of the liquid material 4, with which it can be determined that the liquid material 4 is normally ejected from each of the nozzles 3 of the inkjet heads 2, with respect to the positions in the ejecting direction S of the nozzle 3 at which the position and the liquid width of the liquid material 4 are calculated by the calculation portion 17. Note that the threshold values can be arbitrarily set as values appropriate for determining that liquid material 4 is normally ejected from each of the nozzles 3. In this embodiment, in the normal value storage portion 18, there are set threshold values for determining that the liquid material 4 is normally ejected from each of the nozzles 3 of the inkjet heads 2 with respect to the position and the liquid width of the liquid material 4 at the position closer to the nozzle 3 and the position far from the nozzle 3 which are specified in the virtual blocks A and B, respectively.

Further, the determination portion 19 determines whether the calculated value obtained by the calculation portion 17 is in the range of the normal values which are defined by the threshold values stored in the normal value storage portion 18. In this embodiment, in determining the ejection abnormality, it is determined whether the calculated values obtained at the position closer to the nozzle 3 and at the position far from the nozzle 3 which are specified in the blocks A and B, respectively, are in the range of the threshold values stored in the normal value storage portion 18.

Thus, in the determination as to whether the liquid material 4 is normally ejected from each of the nozzles 3 of the inkjet head 2, it is determined that, in each nozzle 3, the ejection from each of the nozzles 3 is normally performed in a case where the calculated values of the position and the liquid width of the liquid material 4 are in the range of the normal values at both a position A closer to the nozzle 3 and a position B far from the nozzle B. In the other cases, it is determined that there is an abnormality in ejection of the liquid material.

For example, as in a case of nozzles N1, N2, N4, N7, and N9 illustrated in FIG. 10 where the liquid material 4 is normally ejected from each of the nozzles 3 of the inkjet head 2, at both the position A closer to the nozzle 3 and the position B far from the nozzle 3, the position and the liquid width of the liquid material 4 are in the range of the values of normal ejection, so it can be determined that the ejection from each of the nozzles 3 is normally performed.

As in a case of a nozzle N3 where the liquid material 4 is not ejected, the position and the liquid width of the liquid material 4 are not measured at both the position A closer to the nozzle 3 and the position B far from the nozzle 3, so it can be determined as the ejection failure. Further, as in a case of nozzles N5 and N6 where a flying curve of the liquid droplet occurs, at the position B far from the nozzle 3, the position of the liquid material 4 is shifted from the range of the values obtained in the case of normal ejection, so it can be determined as the ejection failure based on the position of the liquid material 4. Further, as illustrated in FIG. 12, when the flying curve occurs in a photographing direction T of the camera 5, the liquid material 4 at the position B far from the nozzle 3 the camera 5 is not focused on, so the liquid material 4 is photographed with a large width as indicated by the dotted line f. As a result, even when the flying curve occurs in the photographing direction of the camera 5, it can be determined as the ejection failure based on the width of the liquid material 4.

Further, as in a case of a nozzle N8 where the liquid material 4 abnormally spreads to be ejected, at the position A closer to the nozzle 3 and at the position B far from the nozzle 3, the liquid material 4 having a large width is photographed, so the ejection abnormality is determined by the liquid width of the liquid material 4. Further, as in a case of a nozzle N10 where an ejection amount of the liquid material 4 is small (size of the liquid droplet is small), the liquid material 4 having a small liquid width is photographed, so it can be determined as the ejection abnormality based on the liquid width of the liquid material 4.

In each of the above-mentioned determinations of the ejection failure, threshold values may be set in an appropriate range with which it can be determined that the liquid material 4 is normally ejected from each of the nozzles 3 of the inkjet head 2 to determine whether the calculated position and liquid width of the liquid material 4 are within the threshold values.

Thus, based on the taken images of the liquid material 4 ejected from each of the nozzle 3 of the inkjet head 2, the ejection abnormality detecting device 1 calculates the position and the liquid width of the liquid material 4 at least two positions in the ejecting direction of the nozzles 3, to thereby detect the ejection abnormality of the nozzle 3. When there occurs an ejection abnormality in the nozzles, a remarkable difference in an amount of characteristic of the position or the liquid width of the liquid material can be obtained. As a result, detection of the ejection abnormality of the nozzles can performed with ease and reliability.

Further, in the ejection abnormality detecting device 1, the light source 6 is opposed to the camera 5 on the opposite side of the camera 5 with respect to the liquid material 4 ejected from the nozzle 3, the light source 6 is disposed such that the direct light 11 projected from the light source 6 does not enter the finer 5*a* of the camera 5, and the reflected light 12 reflected by the liquid material 4 ejected from the nozzle 3 is caused to enter the finder 5*a* of the camera 5 to thereby photograph the liquid material 4. As a result, malfunctions such as halation can be suppressed, the liquid material 4 can be photographed with higher definition, the position and the liquid width of the liquid material 4 can be precisely calculated, and the precision in detecting the ejection abnormality of the ejection abnormality detecting device 1 can be improved.

Note that in the ejection abnormality detecting device 1, when the liquid material 4 is photographed using the camera 5 by irradiating momentary light from the light source 6, as illustrated in FIG. 11, the liquid material 4 ejected from the nozzle 3 can be photographed in a state of liquid droplets. Then, when an interval D between liquid droplets is measured based on the taken images in the state of the liquid droplets, the ejection rate of the nozzle 3 can be measured. Accordingly, the ejection abnormality detecting device 1 can also determine whether the liquid material 4 is ejected from the nozzle 3 at a normal ejection rate.

In the above, description has been given of the ejection abnormality detecting device of the inkjet head according to one embodiment of the present invention, but the ejection abnormality detecting device of the inkjet head according to the present invention is not limited to the above-mentioned embodiment.

For example, in the above-mentioned embodiment, a method of specifying at least two positions in the ejecting direction of the nozzle with respect to the taken image of the liquid material is not limited to the above-mentioned embodiment, but various methods can be employed. With regard to the position in the ejecting direction of the nozzle, which yields the position or the liquid width of the liquid material, a position far from the nozzle in the ejecting direction of the nozzle may be appropriately selected such that malfunctions such as the flying curve can be determined.

(Third Embodiment)

FIGS. 13 to 17 each illustrate a third embodiment of the present invention. As illustrated in FIG. 13, a film forming device 1 according to the third embodiment includes an inkjet head 10, a film thickness setting portion 20, a film thickness data storage portion 30, a gray level distribution chart creating portion 40, and a film forming portion 50.

In this embodiment, in an inkjet nozzle unit 13, line-type inkjet nozzles 12 each including nozzles 11 that eject the liquid material and are arranged in a row are provided in parallel with each other such that the positions of the nozzles 11 are shifted from each other by a half of a nozzle pitch Pn, that is, ½Pn. In the inkjet head 10, the inkjet nozzle units 13 are provided in series by alternately shifting the positions of the nozzles 11 of each of the line-type inkjet nozzles 12 in the direction in which the nozzles 11 are provided in a staggered manner.

In the inkjet head 10, the line-type inkjet nozzles 12 each including the nozzles 11, which eject the liquid material and are arranged in a row, are provided in parallel with each other by alternately shifting the positions of the nozzles 11 by a half of the nozzle pitch. For this reason, the nozzle pitch of the inkjet head 10 as a whole can be set to be narrower than the physical limit at which the nozzle pitch can be narrowed. In addition, adjustment of the ejection timing of each of the line-type inkjet nozzles 12 enables easy adjustment of the dot pitch such as fine coating and rough coating. Further, the inkjet head 10 has a width covering the width of the film forming area of the inkjet nozzle units 13, and the liquid material can be coated on the entire film forming area by one-time scanning.

In this embodiment, in each of the line-type inkjet nozzles 12 of the inkjet head 10, each of the nozzles 11 is supplied with the liquid material from a liquid material supplying portion (not shown) and is caused to inject the liquid material at a predetermined timing in response to an injection command signal sent by a controller (not shown). Though not shown in the figure, for each of the nozzles 11, a pressure control system for ejecting liquid droplets from orifices by a mechanical vibration of a piezoelectric vibration element is adopted. Reference numeral 15 of FIG. 13 denotes a nozzle control portion for sending electrical signals to each piezoelectric vibration element of the inkjet head 10.

Note that, in the present invention, the structure of the inkjet head and the ejection system of each of the nozzles of the inkjet head are not limited to the above-mentioned embodiment. For example, in the above-mentioned embodiment, the inkjet head has a structure in which a plurality of line-type inkjet nozzles are provided in parallel with each other and in series. Alternatively, for example, one line-type inkjet nozzle may be provided, or an arrangement other than the above-mentioned arrangement may be adopted even when a plurality of line-type inkjet nozzles are used.

In the film forming device using the inkjet head 10, a film thickness T is determined based on five elements, that is, a nozzle pitch Pn, a dot pitch Pd, an ejected liquid droplet amount Vj, a solid matter density S of a liquid material, and an ejection pattern Vp.

The film thickness T can be calculated by, for example, multiplying a total ejected liquid droplet amount per unit area (10 square mm) by a film thickness coefficient, as in the following formula (Formula 1).

$$T=(10\div Pn)\times(10\div Pd)\times Vj\times Vp\times S\times M \quad \text{(Formula 1)}$$

In Formula 1, T represents a film thickness (Å), Pn represents a nozzle pitch (μm), Pd represents a dot pitch (μm), Vj represents an injected liquid droplet amount (pL), Vp represents an injection pattern ratio (%), S represents a solid material density (%), and M represents a film thickness coefficient (Å÷(pL÷cm$^2$)).

Of those, the nozzle pitch Pn represents an interval between nozzles of the inkjet head 10. The nozzle pitch Pn is determined by the mechanical structure of the inkjet head 10, and cannot be changed except when, for example, the inkjet head 10 is to be replaced.

The dot pitch Pd represents an interval between liquid droplets ejected onto the material to be coated. The dot pitch Pd is determined by the ejection timing of the inkjet head 10, so the dot pitch Pd can be changed in a relative movement direction (advancing direction) with respect to the material to be coated, but cannot be changed in a direction orthogonal to the relative movement direction (width direction).

The ejected liquid droplet amount Vj represents a liquid amount of liquid droplets ejected from the nozzle 11. The ejected liquid droplet amount Vj is determined based on a voltage and a pulse width of an ejection command signal (electrical signal) sent to each of the line-type inkjet nozzles 12. Each of the line-type inkjet nozzles 12 has a unique ejection characteristic in a relationship between the ejection command signal (voltage and pulse width) and the ejected liquid droplet amount Vj. For this reason, even when the ejection command signals with the same voltage and the same pulse width are sent, the amounts of liquid droplets ejected from the line-type inkjet nozzles 12 slightly vary. Note that, in this embodiment, the pulse width of the ejection command signal to be sent to the line-type inkjet nozzle 12 is always set to be constant, and the voltage is changed to adjust the ejected liquid droplet amount Vj.

The solid material density S of the liquid material represents the ratio of a solid material contained in the liquid material, and also represents the density of the solid material remaining as a film after the liquid material is dried. The solid material density S is a characteristic unique to the liquid material, and after the liquid material is filled, the solid material density S cannot be easily changed.

The ejection pattern Vp represents a pattern of dot positions for ejecting the liquid material from the inkjet head 10. The ejection pattern Vp enables electrical control of the nozzles 11 which eject the liquid material from the inkjet head 10, and can be changed with relative ease. In this embodiment, as the ejection pattern Vp, a gray pattern in which positions for ejecting the liquid material are uniformly provided is used. The gray pattern will be described later.

Of the five elements for determining the film thickness T, the nozzle pitch Pn cannot be easily changed, the dot pitch Pd can be changed to some degree, and the entire film thickness T can be changed, but the film thickness T cannot be partially changed. In addition, it is difficult to easily change the solid material density S of the liquid material because the solid material density S of the liquid material is a characteristic unique to the liquid material which has been once filled.

The film forming device 1 according to this embodiment first selects a certain ejection pattern Vp, and substitutes numerical values of the nozzle pitch Pn and the solid material density S, which are constant, into Formula 1, and substitutes a thickness of a film to be formed for the film thickness T. As a result, (Vj/Pd) can be obtained by dividing the ejected liquid droplet amount Vj by the dot pitch Pd. In this relationship, the ejected liquid droplet amount Vj and the dot pitch Pd are in proportion to each other. When the liquid material is ejected with the selected ejection pattern Vp, the ejected liquid droplet amount Vj and the dot pitch Pd are adjusted such that fusion of the liquid droplets is appropriately performed.

Specifically, the ejected liquid droplet amount Vj and the dot pitch Pd are in proportion to each other, and when the ejected liquid droplet amount Vj is increased, the dot pitch Pd is also increased. When the ejected liquid droplet amount Vj and the dot pitch Pd are excessively increased, the fusion of liquid droplets occurs in a nozzle pitch direction, but the fusion of liquid droplets does not occur in a dot pitch direction. Further, when the ejected liquid droplet amount Vj and the dot pitch Pd are excessively decreased, the fusion of liquid droplets occurs in the dot pitch direction, but the fusion of liquid droplets does not occur in the nozzle pitch direction. The ejected liquid droplet amount Vj and the dot pitch Pd are adjusted such that the fusion of liquid droplets occurs in both the dot pitch direction and the nozzle pitch direction.

Further, in the case where the ejected liquid droplet amount Vj and the dot pitch Pd are constant, when the liquid material is ejected with a gray pattern at a higher density level, the film thickness can be increased, and when the liquid material is ejected with a gray pattern at a lower density level, the film thickness can be reduced. The film forming device 1 corrects, using such an adjustment method, per unit area, the ejection pattern of the liquid material to be ejected into the film forming area, and adjusts, per unit area, the thickness of the film to be formed on the material to be coated, thereby forming a film having a uniform thickness on the material to be coated.

In order to materialize the adjustment method, the film forming device 1 includes the film thickness setting portion 20, the film thickness data storage portion 30, the gray level distribution chart creating portion 40, and the film forming portion 50. In this embodiment, the film thickness setting portion 20, the film thickness data storage portion 30, the gray level distribution chart creating portion 40, and the film forming portion 50 are each materialized by a computer and programs for causing the computer to implement functions thereof.

The film thickness setting portion 20 sets the thickness of the film to be formed on the material to be coated. In this embodiment, the thickness of the film to be formed on the material to be coated is set by using the computer, and the set film thickness is stored in a storage portion (e.g., memory) of the computer. A process of setting the thickness of the film to be formed on the material to be coated is called a film thickness setting process.

The film thickness data storage portion 30 adjusts the ejected liquid droplet amount and the dot pitch by taking the ejection characteristics of the inkjet head 10 into consideration, the liquid material is uniformly test-ejected to the film forming area with the gray pattern at an arbitrarily selected gray level, and the film thickness data storage portion 30 stores the thickness of the film to be formed by the test ejection.

In this embodiment, the film thickness data storage portion 30 includes an ejection characteristic storage portion 31, an ejected liquid droplet amount adjustment portion 32, a gray pattern storage portion 33, and a test ejection control portion 34.

The ejection characteristic storage portion 31 stores the ejection characteristics of the inkjet head 10. In this embodiment, each of the line-type inkjet nozzles 12 of the inkjet head 10 has a characteristic unique to the relationship between the voltage and the pulse width of the ejection command signal, and the ejected liquid droplet amount Vj. However, the pulse width of the ejection command signal is always set to be constant, and the voltage is changed to adjust the ejected liquid droplet amount Vj. For this reason, the ejection characteristic storage portion 31 stores the relationship between the voltage and the ejected liquid droplet amount Vj at the pulse width value.

The ejected liquid droplet adjustment portion 32 has a function for adjusting the ejected liquid droplet amount and the dot pitch of the inkjet head 10. With regard to the adjustment of the ejected liquid droplet amount, the ejected liquid droplet adjustment portion 32 has such a function that the ejection characteristics of the inkjet head, which are stored in the ejection characteristic storage portion 31, are first taken into consideration, and the voltage and the pulse width of the ejection command signal are controlled to eject the liquid droplets by a predetermined ejected liquid droplet amount Vj. In this embodiment, the pulse width of the ejection command signal is always set to be constant, and the voltage is changed to adjust the ejected liquid droplet amount Vj. Accordingly, based on the relationship between the voltage and the ejected liquid droplet amount Vj which are stored in the ejection characteristic storage portion 31, the ejected liquid droplet adjustment portion 32 controls the voltage of the ejection command signal so as to eject liquid droplets by the predetermined ejected liquid droplet amount Vj, thereby adjusting the ejected liquid droplet amount.

Next, in the formula (Formula 1), the ejected liquid droplet amount adjustment portion 32 sets a gray pattern to be selected in a test ejection process described later as the ejection pattern Vp, and adjusts the ejected liquid droplet amount Vj and the dot pitch Pd such that fusion of the liquid droplets occur in both the dot pitch direction and the nozzle pitch direction.

The gray pattern storage portion 33 stores gray patterns for ejecting the liquid material per unit area for each gray level.

The gray pattern represents a pattern for ejecting the liquid droplets per unit area (ejection pattern of liquid material). For example, an ejection pattern for ejecting the liquid material from all the nozzles 11 of the inkjet head 10 with all the dot pitches corresponds to a gray pattern at the gray level of 100%.

For example, as illustrated in FIG. 14, description is given of the gray pattern in a case where dot positions capable of ejecting the liquid material are provided in a lattice manner with a predetermined nozzle pitch Pn1 and dot pitch Pd1 (in the figure, circles d1 each indicated by the solid line and circles d2 each indicated by the broken line represent dot positions capable of ejecting the liquid material). Note that the circles d1 each indicated by the solid line are positioned at odd number dot positions in the nozzle pitch direction in odd number rows in the dot pitch direction, and are positioned at even number dot positions in the nozzle pitch direction in even number rows in the dot pitch direction. Further, the circles d2 each indicated by the broken line are positioned at even number dot positions in the dot pitch direction in odd number rows in the nozzle pitch direction, and are positioned at even number dot positions in the dot pitch direction in even number rows in the nozzle pitch direction.

The ejection pattern for ejecting the liquid material at all the dot positions capable of ejecting the liquid material is called a gray level of 100%. As illustrated in FIG. 15, the gray pattern at the gray level of 100% of this case shows a case where the liquid material is ejected at the dot positions corresponding to both the circles d1 each indicated by the solid line and the circles d2 each indicated by the broken line illustrated in FIG. 14. Note that it can be understood that the ejection at the gray level of 100% is not included in the concept of "gray" to be exact, but in this specification, for convenience of explanation, the ejection of this state is called a gray pattern at the gray level of 100%.

Next, as illustrated in FIG. 16, a gray pattern at a gray level of 50% shows a case where the liquid material is ejected only at the dot positions corresponding to the circles d1 each indicated by the solid line of FIG. 14. As a result, the gray pattern at the gray level of 50% shows a case where the dot positions for ejecting the liquid material are uniformly thinned out by 50% as compared with the gray pattern at the gray level of 100%.

In this embodiment, as illustrated in FIG. 13, the line-type inkjet nozzles 12 each having the nozzles 11 which are arranged in a row are provided in parallel with each other such that the positions of the nozzles 11 are shifted from each other by a half pitch of the nozzle pitch, which are used as one inkjet nozzle unit 13. Accordingly, with respect to each of the inkjet nozzle units 13, the liquid material is ejected while a timing for a line-type inkjet nozzle 12 provided in the first row to eject the liquid material, and a timing for a line-type inkjet nozzle 12 provided in the second row to eject the liquid material are shifted by one dot pitch, respectively, thereby making it possible to eject the liquid material with the gray pattern at the gray level of 50%.

Though not shown in the figure, a gray pattern at a gray level of 70% similarly shows a case where the dot positions for ejecting the liquid material are uniformly thinned out by 30% per unit area, as compared with the gray pattern at the gray level of 100%. Further, a gray pattern at a gray level of 30% shows a case where the dot positions for ejecting the liquid material are uniformly thinned out by 70% per unit area, as compared with the gray pattern at the gray level of 100%.

In this embodiment, the gray pattern storage portion 33 stores gray patterns at arbitrary gray levels from a gray level of 0% to the gray level of 100% which are similarly obtained by uniformly thinning out the dot positions for ejecting the liquid material per unit area. The gray pattern storage portion 33 for storing the individual gray patterns at arbitrary gray levels is exemplified, but the gray pattern storage portion is not limited thereto. Alternatively, for example, it is possible to use one storing a function for calculating and obtaining a gray pattern corresponding to an arbitrary gray level and having a function for calculating and obtaining the gray pattern corresponding to the arbitrary gray level for each case.

Next, the test ejection control portion 34 controls the test ejection for uniformly ejecting the liquid material to the film forming area with the ejected liquid droplet amount Vj and the dot pitch Pd of the inkjet head 10 which are adjusted by the ejected liquid droplet amount adjustment portion 32, and with the gray pattern at the gray level selected from the gray patterns at the arbitrary gray levels stored in the gray pattern storage portion 33. The test ejection control portion 34 sends the ejection command signal to the nozzle control portion 15 of the inkjet head 10, and controls the inkjet head 10 to eject the liquid material with the predetermined gray pattern. A process of performing the test ejection is called a test ejection process.

In this embodiment, in the test ejection process, based on the film thickness T set in the film thickness setting portion 20, the ejected liquid droplet amount Vj, the dot pitch Pd, and the ejection pattern Vp (gray level of gray pattern) are set by the formula (Formula 1). In this embodiment, the ejected liquid droplet amount Vj and the dot pitch Pd are adjusted such that a film is formed with a thickness set in the film thickness setting portion 20 with the gray pattern at the gray level of 50%. In the test ejection process, the liquid material is ejected with the gray pattern at the gray level of 50%.

In this embodiment, the nozzle pitch of each of the inkjet nozzle units 13 is minute, and the ejected liquid droplet amount Vj and the dot pitch Pd are adjusted to an amount at which the ejected liquid droplets are adjacent to each other to be fused, with the gray pattern at the gray level of 50% selected in the test ejection process.

As a result, in the test ejection process, as illustrated in FIG. 17(*a*), the liquid material can be uniformly ejected with respect to the film forming area, the fusion of the ejected liquid droplets similarly occurs in the entire film forming area m, and the film thickness of the liquid material temporarily becomes uniform. Then, in the state illustrated in FIG. 17(*a*), if the liquid material is dried, as illustrated in FIG. 17(*d*), the film is to be formed with the thickness set in the film thickness setting portion 20.

However, in reality, the liquid material is dried from the surface, so, during the drying process, the film thickness is changed as illustrated in FIG. 17(*b*). Note that a film thickness at a central portion m1 of the film forming area m remains virtually unchanged, but a film thickness at a circumferential portion m2 (edge portion and corner portion) of the film forming area m is liable to change. With the same dot pitch Pd, the same ejection pattern Vp, and in the same conditions for drying, almost the same fusion and drying of the liquid droplets occur, so the film thickness obtained after the fusion and drying of the liquid droplets tends to become the same film thickness at the same positions in the film forming area m. In this embodiment, as illustrated in FIG. 17(*b*), the circumferential portion m2 of the film forming area m sticks out to a small extent to the outside from an edge e of the film forming area m.

The film thickness data storage portion 30 stores the thickness of the film formed in the above-mentioned test ejection process. In this embodiment, the film thickness is measured and stored for each area corresponding to the unit area of the gray pattern. In this case, the data on the film thickness of the film thickness data storage portion 30 is constituted by a data map in which the film thicknesses are stored for each unit area with the gray patterns for ejecting the liquid material to the film forming area.

Next, the gray level distribution chart creating portion 40 will be described.

The gray level distribution chart creating portion 40 takes the thickness of the film formed in the test ejection process into consideration, and corrects the gray level of the gray pattern for ejecting the liquid material for each unit area such that the film having a uniform thickness can be formed with the thickness set in the film thickness setting portion.

Specifically, the gray level distribution chart creating portion 40 has a function for creating a gray level distribution chart in which the gray levels of the gray patterns of the liquid material to be ejected to the film forming area, for each unit area of the gray pattern for ejecting the liquid material, are set based on the data on the film thicknesses obtained in the test ejection process, which are stored in the film thickness data storage portion 30. In this embodiment, in the process of creating the gray level distribution chart for creating the gray level distribution chart, the gray level of the gray pattern per unit area is changed by taking into consideration of the gray level of the gray pattern obtained in the test ejection process, and the film thickness per unit area obtained in the test ejection process.

For example, as illustrated in FIG. 17(*c*), at a portion q (see FIG. 17(*b*)) at which the thickness of the film formed in the test ejection process is larger than the film thickness set in the film thickness setting portion 20, the gray level of the gray pattern per unit area is changed to a lower density level. At a portion r (see FIG. 17(*b*)) at which the thickness of the film formed in the test ejection process is smaller than the film thickness set in the film thickness setting portion 20, the gray level of the gray pattern per unit area is changed to a higher density level. A degree of change of the gray level is adjusted based on a degree of difference between the film thickness stored in the film thickness data storage portion 30 and the film thickness set in the film thickness setting portion 20. The adjustment may be performed by calculation or may be performed using data based on an empirical rule to some extent.

A process of creating the gray level distribution chart in the gray level distribution chart creating portion 40 is called a gray level distribution chart creating process. Note that, in this embodiment, as illustrated in FIG. 17(*b*), the circumferential portion m2 of the film forming area m sticks out to a small extent to the outside of the film forming area m from the edge e in the drying process. For this reason, in the gray level distribution chart creating process, as illustrated in FIG. 17(*c*), an outer edge of the area to which the liquid material is ejected is set at a little inner side of the edge e by taking into consideration of the circumferential portion m2 of the film forming area m sticking out to a small extent to the outside of the film forming area m from the edge e.

Further, in this embodiment, in the test ejection process, the ejected liquid droplet amount and the dot pitch are adjusted such that the film is formed with the gray pattern at the gray level of 50% and with the thickness set in the film thickness setting portion 20, and the liquid material is ejected with the gray pattern at the gray level of 50%. Accordingly, in the gray level distribution chart creating process, there are provided the same adjustment areas for adjusting the gray level of 50% to the higher density level and to the lower density level, thereby making it possible to easily correct the gray level. Note that, as described above, it is necessary to perform adjustment of the gray level to the higher density level and to the lower density level in the gray level distribution chart creating process, and thus, in the test ejection process, the ejection of the liquid material is always performed at the gray level lower than the gray level of 100%.

Further, particularly in the drying process, as compared with the central portion m1 of the film forming area m, the film thickness at the circumferential portion m2 (edge portion and corner portion) is liable to change. For this reason, in the film formed in the test ejection process, as illustrated in FIG. 17(*b*), the film thickness at the central portion m1 of the film forming area m is substantially uniform, but at the circumferential portion m2 (edge portion and corner portion), a difference in film thickness tends to occur. In the gray level distribution chart creating process, by focusing on the tendency, as illustrated in FIG. 17(*c*), at the central portion m1 of the film forming area m, the gray level of the gray pattern may be uniformly corrected, and at the circumferential portion m2, the gray level of the gray pattern may be corrected. As a result, a labor for the operation of the gray level distribution chart creating process can be saved, whereby the efficiency for the operation can be improved.

Further, at the circumferential portion m2 of the film forming area m, through the drying process after the fusion of liquid droplets, the tendency of the film thickness caused at the edge portion and the tendency of the film thickness caused at the corner portion are substantially equal to each other irrespective of the positions of the edge portion and the corner portion. In the gray level distribution chart creating process, by taking such tendencies into consideration, the gray level with respect to a certain edge portion is corrected per unit area, which may be copied to another edge portion, and the gray level with respect to a certain corner portion is corrected per unit area, which may be copied to another edge portion. As a result, the labor for the operation of the gray level distribution chart creating process can be further saved, and the efficiency for the operation can be further improved.

Next, the film forming portion 50 has a function for ejecting the liquid material onto the material to be coated, based on the gray level distribution chart created in the gray level distribution chart creating portion 40, to thereby form the film. The film forming portion 50 sends the ejection command signal to the nozzle control portion 15 of the inkjet head 10, and controls the inkjet head 10 to eject the liquid material, based on the gray level distribution chart created in the gray level distribution chart creating portion 40.

The film forming portion 50 corrects, in the gray level distribution chart creating portion 40, the gray level of the gray pattern of the liquid material to be ejected onto the material to be coated, based on the results of the test ejection process such that a film having a uniform thickness can be formed with the film thickness set in the film thickness setting portion 20. Accordingly, as illustrated in FIG. 17(*d*), the film having the uniform thickness can be formed.

As described above, the film forming device enables formation of the film having the uniform thickness by means of the film thickness setting portion 20, the film thickness data storage portion 30, the gray level distribution chart creating portion 40, and the film forming portion 50.

Further, the film forming device 1 may repeat the gray level distribution chart creating process a plurality of times in such a manner that the test ejection process, the gray level distribution chart creating process, the film forming process (second test ejection process), the gray level distribution chart creating process, the film forming process (third test ejection process), and the like are executed in the stated order. Thus, the gray level distribution chart creating process is performed again assuming the film formed in the film forming process as a film formed in the test ejection process, the gray level distribution chart creating process is further performed assuming the film formed in the film forming process as a film formed in the test ejection process, and the gray level distribution chart creating process is repeated a plurality of times. As a result, the film having the uniform thickness can be formed with extremely high precision.

In a case where the film is produced in a room whose environment is controlled to be constant, such as a cleanroom, the tendency of the fusion of liquid droplets is constant, and drying conditions for a drier are also constant. Accordingly, if a distribution chart of gray levels which are adjusted with high precision is created once, the gray level distribution chart can be repeatedly used at a mass production step. As a result, the film having the uniform thickness can be mass-produced with high precision.

The film forming method and the film forming device according to one embodiment of the present invention has been described above, but the present invention is not limited to the above-mentioned embodiment.

Note that, in the inkjet head 10 illustrated in FIG. 13, the nozzle pitch can be made narrower than the physical limit to the reduction of the nozzle pitch, and in addition, the nozzle positions for ejecting the liquid material to the dot positions, which are adjacent to each other in the nozzle pitch direction, are positioned between the adjacent dot positions, and a time difference in ejecting the liquid material becomes smaller. As a result, the fusion of liquid droplets among the adjacent dot positions can be performed more appropriately. The inkjet head 10 has the above-mentioned characteristics, so the inkjet head 10 is a preferable mode to be adopted for the film forming device of the present invention which attempts to make the difference in film thickness, which is caused due to the change in film thickness in the fusion of liquid droplets and in the drying process after the fusion of liquid droplets, uniform.

(Fourth Embodiment)

FIGS. 18 to 25 each illustrate a fourth embodiment of the present invention. In the fourth embodiment, the present invention is applied to an orientation film coating device for a transparent substrate of a liquid crystal display device. As illustrated in FIG. 18, the film coating device includes a base 71 on which a transparent substrate 70 being a material to be coated is horizontally fixed and placed, and a print head unit 72 which moves in a direction of the arrow A along a guide rail (not shown) mounted on the base 71. The transparent substrate 70 is horizontally fixed by a plurality of known clamp means (not shown) on the base 72. The print head unit 72 can be moved in the direction of the arrow A by given drive means. As the drive means, a linear motor system with excellent constant velocity stability and with no backlash is most appropriately used. Specifically, the print head unit 72 is slidably mounted on a linear guide rail provided on the base 72, and a linear motor is constituted by a plurality of magnets provided to be adjacent to both opposed surfaces of the guide rail and the print head. Other examples of the drive means may include belt drive means including a motor, a pulley, and a belt with teeth combined with each other, and screw rod drive means including a motor and a screw rod combined with each other. In the belt drive means, an endless belt with teeth is held taut under tension in a horizontal direction of FIG. 18, and the belt with teeth is wrapped around the pulleys provided at both right and left ends. A part of the belt with teeth is connected to the print heat unit 72, and one of the pulleys is driven to be rotated in a forward direction or in a reverse direction by a servomotor or the like, thereby causing the print head unit 72 to advance and recede in the horizontal direction. In the screw rod drive means, the screw rod is provided in the horizontal direction of FIG. 18, a part of the print head unit 72, which is slidably provided by the guide rail but is not capable of rotating about a central axis in a case where a sliding direction is assumed as the central axis, is screwed into the screw rod, and the screw rod is driven to be rotated in the forward direction or in the reverse direction by the servomotor or the like. As a result, the print head unit 72 is caused to advance and recede in the horizontal direction.

The print head unit 72 has a plurality of print heads 73 mounted thereto. FIG. 18 illustrates a state where only 7 print heads 73 are mounted in a staggered manner as a simplified diagram, but the number of the print heads 73 can be increased or reduced so as to correspond to the width of the transparent substrate 70. For example, in a case where the width of the transparent substrate 70 is 1500 mm, the number of print heads 73 to be mounted is generally set to 40 to 50. The print heads 73 are arranged in a staggered manner so as to prevent an interval between dot films of a coating liquid from being excessively large among the adjacent print heads 73.

FIG. 19 illustrates a pipeline including a supply pipe 13 for supplying a coating liquid to the print head 73, and a recovery pipe 83 for the coating liquid. In the device according to the present invention, a supply tank 12, a feed pump 15, and a recovery tank 8 are arranged at a low position on a fixation side of the film coating device. For this reason, it is necessary to provide the supply pipe 13 and the recovery pipe 83 for the print head 73. If the print head unit 72 has enough space, the supply tank 12, the feed pump 15, and the recovery tank 8 may be mounted on a movement side, that is, mounted to the print head unit 72, and the supply pipe 13 and the recovery pipe 83 may also be mounted to the print head unit 72. An $N_2$ supply pipe 80 and an atmosphere releasing pipe 81 cannot be omitted, so at least two pipes, that is, the $N_2$ supply pipe 80 and the atmosphere releasing pipe 81, are necessary as a pipeline provided between the fixation side and the movement side. The $N_2$ supply pipe 80 is connected to an $N_2$ cylinder provided on the fixation side. The atmosphere releasing pipe 81 is connected to a solvent disposal processing system provided in a plant.

The four pipes of the supply pipe 13, the recovery pipe 83, the $N_2$ supply pipe 80, and the atmosphere releasing pipe 81 are contained in a common cable bear 82. A side of the cable bear 82, which is bent in an arc shape, is directed in a movement direction (advancing direction or receding direction) of the print head unit 72.

The supply tank 12 is an upright flat container with an upper portion for releasing the atmosphere, and stores the coating liquid inside thereof. One end of the supply pipe 13 is immersed in the coating liquid provided inside the supply tank 12. The feed pump 15 is mounted to the supply pipe 13 at a position closer to the supply tank 12. The coating liquid is fed out to the supply pipe 13 by the feed pump 15. A supply valve 14 is mounted to the supply pipe 13 at a position closer to the feed pump 15 at a downstream side of the feed pump 15.

An ink tank 1 is hermetically sealed, and stores one kind of coating liquid. The ink tank 1 is provided at a position higher than the supply tank 12 and the recovery tank 8, and is provided with a level switch 16 for detecting a coating liquid surface, and with an internal pressure gauge 17. The level switch 16 detects a case where a coating liquid surface becomes equal to or lower than a predetermined height in the ink tank 1, and causes the feed pump 15 to operate, thereby maintaining the height of the coating liquid surface in the ink tank 1 to be constant. The internal pressure gauge 17 detects the pressure of the ink tank 1.

The ink tank 1 is connected in parallel with the $N_2$ supply pipe 80 and the atmosphere releasing pipe 81. The $N_2$ supply pipe 80 introduces an inert gas for pressurization such as a nitrogen gas into the ink tank 1, and pressurizes the interior of the ink tank 1 at the predetermined pressure, thereby promoting the coating liquid to be filled in the print head 73. The atmosphere releasing pipe 81 releases a surplus gas for pressurization to the atmosphere in a case where the pressure inside the ink tank 1 becomes equal to or larger than the predetermined pressure, thereby maintaining the pressure inside the ink tank 1 at the predetermined pressure. The $N_2$ supply pipe 80 has an upstream end on the fixation side, and is connected to an inert gas source for pressurization such as a nitrogen gas tank. At the upstream side of the $N_2$ supply pipe 80, a purge pressure regulator 31, a purge pressure gauge 32, and a purge valve 33 are provided in the stated order. The downstream side of the purge valve 33 communicates with an inner upper space of the ink tank 1 through a part of a vertical pressure control pipe 29 and a part of a horizontal pressure variable base pipe 25, and a tank valve 26. The pressure control pipe 29 is connected to the middle portion of the pressure variable base pipe 25. At the middle portion of the pressure control pipe 29, each one end of a horizontal return pipe 34 and a horizontal branch pipe 39 is connected. The other end of the return pipe 34 is connected to the upstream side of the purge pressure regulator 31. The return pipe 34 is provided with an atmosphere releasing regulator 35, a pressure gauge for releasing the atmosphere 36, and an atmosphere releasing valve 37 in the stated order from the upstream side of the purge pressure regulator 31. An auxiliary branch pipe 38 is connected to the return pipe 34 between the atmosphere releasing regulator 35 and the pressure gauge for releasing the atmosphere 36. The auxiliary branch pipe 38 is connected the atmosphere releasing pipe 81 in parallel with the branch pipe 39. The branch pipe 39 is provided with a negative pressure pump 41 and a negative pressure valve 42 in the stated order from the downstream side. The negative pressure pump 41 forcibly releases a gas provided in the pressure control pipe 29 into the atmosphere releasing pipe 81. The pressure variable base pipe 25 is connected to a middle portion of a bypass pipe 18*a* through a bypass valve 27.

A coating liquid is supplied from the ink tank 1 to each of the print heads 73 through a common liquid feed pipe 2 and separate liquid feed pipes 3. The separate liquid feed pipes 3 branch from the common liquid feed pipe 2 at the same intervals. A distal end of each of the separate liquid feed pipes 3 is connected to each of the print head 73 through deaerating means 5. Each of the print heads 73 and the deaerating means 5 may be separated from each other as separate bodies illustrated in the figure, or may be integrated with each other. A liquid feed valve 7 and a recovery valve 10 are provided at both ends of the common liquid feed pipe 2, that is, at the upstream side extremely close to the separate liquid feed pipe 3 at the uppermost stream position with respect to the common liquid feed pipe 2, and at the downstream side extremely close to the separate liquid feed pipe 3 at the lowermost stream position with respect to the common liquid feed pipe 2, respectively. The recovery valve 10 is connected to the recovery pipe 83 through a recovery sensor 11.

Each of the print heads 73 is connected to a separate gas flow pipe 19 which vertically rises upward. Upper ends of the separate gas flow pipes 19 each extend upward of the liquid surface of the ink tank 1, and are each connected to the horizontal bypass pipe 18*a*. The bypass pipe 18*a* extends in the horizontal direction at an upper position higher than the uppermost liquid surface of the ink tank 1. One end of the bypass pipe 18*a* is connected to the separate gas flow pipe 19 provided at the uppermost stream side, and a lower end of the bypass pipe 18*a* is connected to an upstream end of the recovery pipe 83, that is, at a position where the recovery sensor 11 is connected to the recovery pipe 83.

At a connecting position for the separate gas flow pipe 19 which is connected to the lowermost end of the common liquid feed pipe 2, a lower end of a liquid feed gas flow pipe 20 is connected. An upper end of the liquid feed gas flow pipe 20 is connected to the bypass pipe 18*a* at the upstream side extremely close to a gas releasing valve 23 through a liquid filling confirmation sensor 21.

As illustrated in FIG. 19, in the present invention, there is employed one common liquid feed pipe 2 which is commonly used in the pipeline for supplying the coating liquid with respect to the plurality of print heads 73. In other words, the coating liquid is supplied not in parallel but in series to each of the print heads 73, thereby reducing the number of pipelines for supplying the coating liquid to the print heads 73 and the number of the control devices to a large extent, and simplifying the structure. This is one of the factors for achieving the method of the present invention in which the print head 73 side is moved.

The cable bear 82 is used as means for supplying a liquid, a gas, or electricity from one side to the other side between the fixation side and the movement side. The cable bear 82 naturally supports flexible pipes and wirings as a bundle, in a freely bendable manner, and causes the print head unit 72 provided on the movement side to move with less resistance. The cable bear 82 is formed of, for example, a flexible tube having a flat cross section, and contains a plurality of pipes, wirings, and the like inside thereof.

While, in the device required for movement control with high precision, such as the film coating device for the transparent substrate 70 of the liquid crystal display device, which is a target to which the present invention is applied, the number of pipes, wirings, and the like to be contained in the cable bear is desirably reduced as much as possible. In the cable bear 82 used in the present invention, the number of pipes and the like provided between the fixation side and the movement side is only 4 in total, so it is possible to perform the movement control with high precision for the print head unit 72 as well.

On the other hand, the wiring for the print head 73 provided on the movement side of the film coating device is generally made such that, based on a conventional idea, as illustrated in FIG. 20(B), a coating data signal line 91, a high pressure pulse line 92, and a power supply line 93 are wired with respect to each of the print heads 73 from a coating control portion 94 including a computer, in a form of an electrical wire bundle 95. However, it is necessary to contain the electrical wire bundles 95 by the amount corresponding to the number of the print heads 73, with the result that, in a case where a plurality of print heads 73 are arranged over the entire width of the transparent substrate 70, the electrical wire bundle 95 cannot be contained in the cable bear 82.

As means for solving the above-mentioned problem, the coating control portion 94 is disposed near the print heads 73 as illustrated in FIG. 20 (A), and the coating control portion 94 and a control portion 96 provided on the fixation side are connected to each other via a transmission line 85 (for example, transmission method with RS-422 differential line). Coating data and high pressure pulse data are serially transmitted to the coating control portion 84 via the transmission line 85. The coating control portion 94 is provided with a relay board of a serial-in-parallel-out shift register type. The coating data and the high pressure data are delivered to each of the print heads 73 via the relay board. Thus, by delivering the data for the plurality of print heads 73 in parallel via one transmission line 85, the number of wirings provided in the cable bear 82 can be reduced to a large extent, which is one of the factors for achieving the method of the present invention in which the print head 73 side is moved.

In addition, in FIG. 20(B), the purge valve using a "solenoid", the liquid filling confirmation sensor serving as a "detector", and the like are each wired to the coating control portion 94 through the cable bear 82 with a multi-conductor cable 97. However, in the device of the present invention, as illustrated in FIG. 20(A), the purge valve 33 and the liquid filling confirmation sensor 21 can be wired to the control portion 96 via a wiring saving system 90 (for example, CC-Link or DeviceNet). As a result, leading wirings for the purge valve 33 and the liquid filling confirmation sensor 21 can be bundled as one cable, and the number of wirings provided in the cable bear 82 can be reduced. Control & Communication Link (CC-Link) and DeviceNet are field network systems which realize control and information data processing at the same time and at high speed, which enables easy interconnection among control devices such as a PLC, a personal computer (PC), a sensor, and an actuator. The CC-Link and DeviceNet are each known as a technology capable of reducing wiring costs by wiring saving.

The other wirings, that is, electrical wires for the feed pump 15 and the negative pressure pump 41 of FIG. 19, are directly wired on the fixation side through the cable bear 82 as illustrated in FIGS. 20(A) and 20(B).

As described above, the cable bear 82 is used as means for supplying a liquid, a gas, or electricity to the movement side. As apparent from comparison between FIGS. 20(A) and 20(B), in order to control the movement of the print head unit 72 with high precision, it is necessary to reduce the number of the wirings to be contained in the cable bear 82 to the minimum. As illustrated in FIG. 20(B), as the number of the print heads 73 to be arranged is increased, the number of the electrical wire bundles 95 is proportionately increased, with the result that the film coating device cannot be realized in effect. On the other hand, as illustrated in FIG. 20(A), even if the number of the print heads 73 to be arranged is increased, it is sufficient that the electrical wire bundle 95 is wired to the coating control portion 94, and thus, the number of wirings to be contained in the cable bear 82 is not increased. Accordingly, although several wirings related to the power supply are not used in common but are directly wired to the fixation side, an exceedingly large number of wirings related to the data can be packaged as one bundle with a high-speed transmission line by using the serial-in-parallel-out shift register.

Even when the total number of the pipes of FIG. 19 and the total number of the electrical wires of FIG. 20(A) are summarized, the obtained total number thereof is small enough to be contained in the cable bear 82. As a result, it is possible to realize the movable print head unit 72 which includes the large number of print heads 73, is large, and is capable of performing movement control with high precision.

In the present invention, as described above, the plurality of print heads 73 arranged over the entire width of a material to be coated G are once moved by the length of the material to be coated G in the direction orthogonal to the direction in which the print heads 73 are arranged, through the movement control with high precision. As a result, it is possible to form an excellent coating surface with a uniform pressure, which has no seam between films on the entire surface of the material to be coated G, that is, which has no unevenness in film thickness.

Next, in order to prevent the liquid surface of the ink tank 1 from waving, as illustrated in FIG. 21, a width H of the ink tank 1 is made thin in the movement direction thereof, and a plurality of baffle plates 100 are provided in parallel with each other so that the baffle plates 100 vertically intersect the coating liquid surface of the ink tank 1. In addition, travelling speed of the print head unit is controlled so that the liquid surface of the ink tank 1 does not wave to a large extent. Specifically, the acceleration at the time of starting the movement of the print head unit in the longitudinal direction of the material to be coated G is suppressed. By the two countermeasures, the coating liquid can be supplied from the ink tank 1 to each of the print heads 73 at a stable meniscus pressure without causing the liquid surface of the ink tank 1 to wave, that is, without generating foam. As a result, the coating liquid is stably ejected from each of the print heads 73, and the thickness of the dot-shaped coating film becomes uniform.

The coating liquid is supplied from the supply tank 12 of FIG. 19 to each of the print heads 73 through the ink tank 1, and when the liquid waves in the ink tank 1, a degree of deaeration of the coating liquid is lowered. In order to increase the degree of deaeration, it is necessary to provide the deaerating means 5 of a small type near each of the print heads 73.

By supplying a deaerated coating liquid to each of the print heads 73, it is possible to cause each of the print heads 73 to eject a stable coating liquid.

In the case where the ink tank 1 and the print heads 73 illustrated in FIG. 19 are moved, if the meniscus pressure which is the internal pressure of each of the print heads 73 is not stabilized, the coating liquid is not stably ejected from the print head 73.

Therefore, the meniscus pressure of the ink tank 1 and each of the print heads 73 is controlled with high precision (desirably, pulsatile pressure of ±5 Pa or smaller) with the negative pump 41 of FIG. 19, thereby making it possible to stably eject the coating liquid from each of the print heads 73.

Next, supply of the coating liquid from the ink tank 1 to each of the print heads 73 will be described in detail. With regard to the control of a storage amount of the coating liquid in the ink tank 1, through an operation of the feed pump 15, the coating liquid is supplied from the supply tank 12, which stores a large amount of coating liquid, to the ink tank 1 through the supply valve 14 which is in an opened state. In this case, a vertical level of the liquid surface of the coating liquid contained in the ink tank 1 is controlled by the level switch 16, thereby maintaining the interior of the ink tank 1 in a state where a predetermined amount of coating liquid is constantly stored.

Next, in a case where the coating liquid is fed from the ink tank 1 to each of the plurality of print heads 73, in a state where the purge valve 33 provided on the pressure control pipe 29 and the tank valve 26 provided on the pressure variable base pipe 25 are opened, a gas such as nitrogen is pressure-fed into the space above the liquid surface in the ink tank 1, and the internal pressure is increased. In this state, the liquid feed pipe 7 and the recovery valve 10 which are provided on the common liquid feed pipe 2, and the gas releasing valve 23 provided on the bypass pipe 18*a* (common gas flow pipe 18) are opened, and the coating liquid contained in the ink tank 1 is fed to each of the print heads 73 through the common liquid feed pipe 2 and each of the separate liquid feed pipes 3. In this case, the gas supplied together with the coating liquid in the common liquid feed pipe 2 flows into the bypass pipe 18*a* (common gas flow pipe 18) through the recovery valve 10 to be released into the atmosphere, and the gas contained in each of the print heads 73 flows into the bypass pipe 18*a* through each of the separate gas flow pipes 19 to be released into the atmosphere through the gas releasing valve 23.

After that, when the coating liquid is continuously fed, the coating liquid is filled in each of the print heads 73. At this point of time, the internal pressure of each of the print head 73 is equalized by means of the bypass pipe 18*a* of the common gas flow pipe 18, with the result that the coating liquid is equally filled in each of the print heads 73. At a time when the coating liquid reaches the recovery sensor 11 from the common liquid feed pipe 2 through the recovery valve 10, the recovery valve 10 is closed. Further, at a time when the liquid filling confirmation sensor 21 detects that the coating liquid is increased to a predetermined level in the liquid feed gas flow pipe 20, the gas releasing valve 23 is closed, and at a time when the coating liquid filled in each of the print heads 73 reaches the ejection nozzle of each of the print heads 73 and drops, the purge valve 33 and the liquid feed valve 7 are closed, thereby completing the liquid feeding operation from the ink tank 1 to each of the print heads 73. In this case, the level of the liquid surface in the ink tank 1 and an installation position of the liquid filling confirmation sensor 21 are set to be the same or substantially the same height level. Accordingly, in each of the separate gas flow pipes 19, the coating liquid is increased to the height equal to or substantially equal to the installation position of the liquid filling confirmation sensor 21.

At this point of time, the interior of each of the print heads 73 and the ink tank 1 is pressurized, so the atmosphere releasing valve 37 is first opened so as to set the internal pressures thereof to the atmospheric pressure. In this case, the atmosphere releasing regulator 35 allows nitrogen to be constantly released into the atmosphere through the auxiliary branch pipe 38 at a pressure of 0.1 kPa so as to prevent backflow of the atmosphere. Accordingly, the auxiliary branch pipe 38 is in a state of a nearly atmospheric pressure, and is depressurized to the state of atmospheric pressure through the atmosphere releasing valve 37. After that, the atmosphere releasing valve 37 is closed, and the negative valve 42, the tank valve 26, the bypass valve 27, and the liquid valve 7 are each opened to lower the internal pressure of each of the print heads 73 to a predetermined negative pressure through the operation of the negative pump 41, thereby obtaining a state where the coating liquid can be appropriately ejected from each of the print heads 73. At this point of time, the coating liquid contained in each of the print heads 73 is affected by the negative pressure acting on the space above the liquid surface in the ink tank 1 and by the negative pressure acting on the bypass pipe 18*a*. Therefore, the negative pressure acts on the coating liquid contained in each of the print heads 73 with uniformity, excellent responsiveness, and stability.

The invention claimed is:

1. A film forming method, for ejecting a liquid material using an inkjet head to form a film having a uniform thickness on a material to be coated, comprising:

a film thickness setting step of setting a thickness of the film to be formed on the material to be coated;

a test ejection step of adjusting an ejected liquid droplet amount and a dot pitch while taking ejection characteristics of the inkjet head into consideration, and of performing a test ejection of the liquid material with respect to a film forming area with a gray pattern at an arbitrarily selected gray level;

a gray level distribution chart creating step of creating a distribution chart in which gray levels of gray patterns of the liquid material to be ejected are set for each unit area, with respect to the film forming area in which the film is formed on the material to be coated, based on the thickness of the film formed in the test ejection step such that the film having the uniform thickness can be formed with the film thickness set in the film thickness setting step; and a film forming step of ejecting the liquid material onto the material to be coated with a gray pattern at a gray level based on the gray level distribution chart created in the gray level distribution chart creating step, while the ejected liquid droplet amount and the dot pitch which are adjusted in the test ejection step are maintained, to form the film on the material to be coated.

2. A film forming method according to claim 1, wherein the test ejection step comprises selecting the ejected liquid droplet amount, the dot pitch, and the gray level of the gray pattern based on the film thickness set in the film thickness setting step.

3. A film forming method according to claim 1, wherein the gray level distribution chart creating step comprises creating a distribution chart in which gray levels of gray patterns of the liquid material to be ejected are set for each unit area, with respect to a circumferential portion of the film to be formed on the material to be coated.

4. A film forming method according to claim 1, wherein the gray level of the gray pattern is selected from a range of from 30% to less than 100% in the test ejection step.

5. A film forming method according to claim 1, wherein the gray pattern at a gray level of 50% is selected in the test ejection step.

6. A film forming method according to claim 1, wherein the gray level distribution chart creating step further comprises, in creating the gray level distribution chart with respect to a circumferential portion of the film to be formed on the material to be coated, the steps of:

creating a distribution chart in which gray levels of gray patterns of the liquid material to be ejected are set for each unit area, with respect to an arbitrarily selected edge portion and corner portion; and copying the created distribution chart to each of the edge portion and the corner portion to create the gray level distribution chart.

7. A film forming method according to claim 1, further comprising performing once or repeating a plurality of times the gray level distribution chart creating step and the film forming step again, after formation of the film in the film forming step, with the film formed in the film forming step being used as the film formed in the test ejection step.

8. A film forming device, which ejects a liquid material using an inkjet head to form a film having a uniform thickness on a material to be coated, comprising:

a film thickness setting portion for setting a thickness of the film to be formed on the material to be coated;

a film thickness data storage portion for adjusting an ejected liquid droplet amount and a dot pitch by taking ejection characteristics of the inkjet head into consideration, test-ejecting the liquid material with respect to a film forming area with a gray pattern at an arbitrarily selected gray level, and storing the thickness of the film formed in the test ejection;

a gray level distribution chart creating portion for creating a distribution chart in which gray levels of gray patterns of the liquid material to be ejected are set for each unit area, with respect to the film forming area in which the film is formed on the material to be coated, based on film thickness data stored in the film thickness data storage portion, such that the film having the uniform thickness can be formed with the film thickness set in the film thickness setting portion; and a film forming portion for ejecting the liquid material onto the material to be coated with a gray pattern at a gray level based on the gray level distribution chart created in the gray level distribution chart creating step, while the ejected liquid droplet amount and the dot pitch which are adjusted in the test ejection step are maintained, to form the film on the material to be coated.

* * * * *